US011134768B2

(12) United States Patent
Hoskins

(10) Patent No.: US 11,134,768 B2
(45) Date of Patent: Oct. 5, 2021

(54) HYDRATION BLADDERS

(71) Applicant: TSI Manufacturing, LLC, Bend, OR (US)

(72) Inventor: Matthew Hoskins, Bend, OR (US)

(73) Assignee: TSI Manufacturing, LLC, Bend, OR (US)

( * ) Notice: Subject to any disclaimer, the term of this patent is extended or adjusted under 35 U.S.C. 154(b) by 0 days.

(21) Appl. No.: 16/749,830

(22) Filed: Jan. 22, 2020

(65) Prior Publication Data

US 2020/0229578 A1 Jul. 23, 2020

Related U.S. Application Data

(60) Provisional application No. 62/918,219, filed on Jan. 22, 2019.

(51) Int. Cl.
*A45F 3/20* (2006.01)
*A45F 3/16* (2006.01)

(52) U.S. Cl.
CPC ..... *A45F 3/20* (2013.01); *A45F 2003/166* (2013.01)

(58) Field of Classification Search
CPC ..... A45F 3/20; A45F 2003/166
USPC ..... 222/92, 93, 95, 105, 107, 210–215, 206, 222/539, 464.5, 534, 525; 224/148.1, 224/148.2, 148.7; 220/703, 705–710; 383/80, 119
See application file for complete search history.

(56) References Cited

U.S. PATENT DOCUMENTS 4,627,554 A 12/1986 Leibinsohn
6,854,888 B1 * 2/2005 Brown ..... A45F 3/20 222/107
7,063,243 B2 6/2006 Forsman et al.
7,448,509 B2 11/2008 Yang
7,600,656 B2 10/2009 Karl et al.
10,315,816 B2 6/2019 Ehyai et al.
2001/0003342 A1 * 6/2001 Faughnder ..... B65D 47/243 222/211
2004/0089629 A1 * 5/2004 Villaescusa ..... B65D 17/4012 215/388
2005/0072804 A1 * 4/2005 Brown ..... A45F 3/20 222/175
2006/0257057 A1 * 11/2006 Andersen ..... B65D 75/008 383/104

(Continued)

FOREIGN PATENT DOCUMENTS

WO WO 2010/151848 A2 * 12/2010
WO WO 2011/0031010 A2 * 1/2011

OTHER PUBLICATIONS

New capCAP, www.humangear.com/gear/capcap, downloaded Feb. 7, 2017, 10 pages.

*Primary Examiner* — Lien M Ngo

(74) *Attorney, Agent, or Firm* — Klarquist Sparkman, LLP

(57) ABSTRACT

Disclosed herein are embodiments of hydration bladders that include flexible wall portions along with relatively more rigid structural portions that are shaped to help define the shape of the bladder and can also help a user grip and manipulate the bladder. The structural portions can also support or incorporate other bladder features, such as inlet ports, caps, outlet ports, valves, tubes, attachment points, graphic designs, and/or other features. Some embodiments include an outlet tube that is retractable and extendable through an upper port at the top of the bladder.

20 Claims, 17 Drawing Sheets

(56) References Cited

U.S. PATENT DOCUMENTS

| | | | | |
|---|---|---|---|---|
| 2007/0047851 | A1* | 3/2007 | Sato | B29C 66/1122 383/104 |
| 2010/0044396 | A1 | 2/2010 | Skillern | |
| 2011/0006084 | A1* | 1/2011 | Staton | A45F 3/20 222/175 |
| 2011/0132932 | A1* | 6/2011 | Duran | A45F 3/20 222/175 |
| 2016/0362229 | A1 | 12/2016 | Hoskins | |
| 2017/0086568 | A1* | 3/2017 | Ehyai | A45F 3/04 |
| 2017/0127806 | A1* | 5/2017 | Smith | A45F 3/20 |
| 2017/0347778 | A1* | 12/2017 | Hoskins | A45F 3/20 |

* cited by examiner

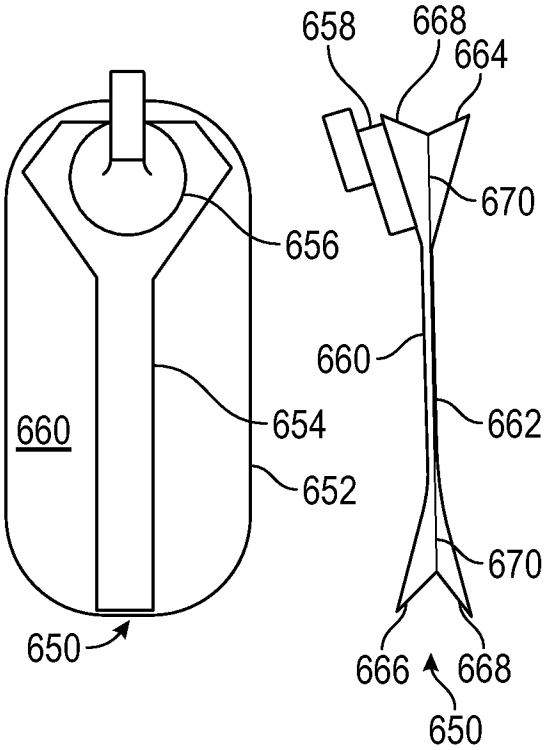
FIG. 32
FIG. 31
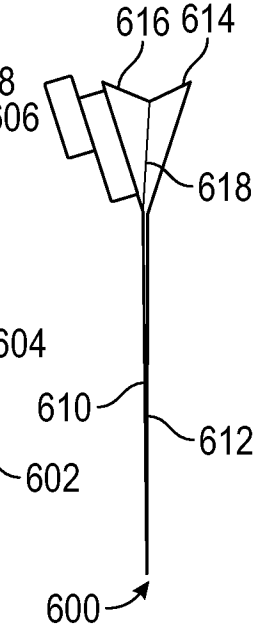
FIG. 30
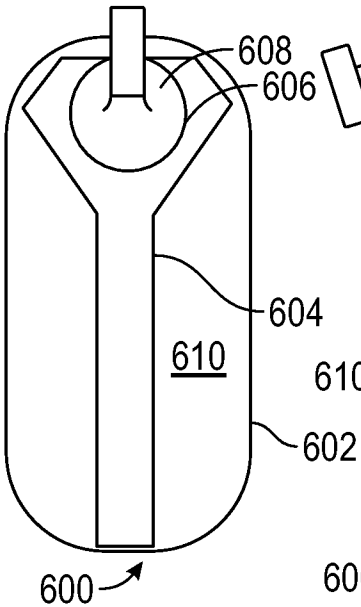
FIG. 29
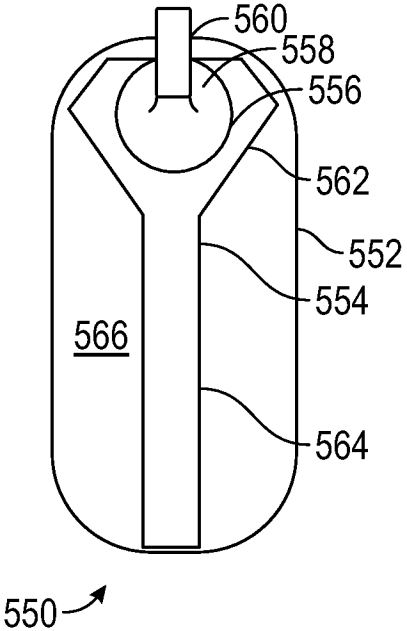
FIG. 28

HYDRATION BLADDERS

CROSS-REFERENCE TO RELATED APPLICATIONS

This application claims priority to U.S. Provisional Patent Application No. 62/918,219 filed Jan. 22, 2019, which is herein incorporated by reference in its entirety.

FIELD

This application relates to the field of hydration bladders for containing and dispensing fluids for drinking.

BACKGROUND

Conventional bladders include flexible walls that define an internal fluid space that can expand and contract in volume, along with a port for adding and dispensing the fluid.

SUMMARY

Disclosed herein are embodiments of hydration bladders that include flexible wall portions along with relatively more rigid structural portions that are shaped to help define the shape of the bladder and can also help a user grip and manipulate the bladder. The structural portions can also support or incorporate other bladder features, such as inlet ports, caps, outlet ports, valves, tubes, attachment points, graphic designs, and/or other features.

The foregoing and other objects, features, and advantages of the disclosed technology will become more apparent from the following detailed description, which proceeds with reference to the accompanying figures.

BRIEF DESCRIPTION OF THE DRAWINGS

FIG. 28 shows a bladder having a front strut member with a front fluid port.

FIGS. 29-30 show a bladder having a front strut member with a front fluid port, where the top of the bladder is gusseted.

FIG. 31-32 show a bladder having a front strut member with a front fluid port, where the top and bottom of the bladder are gusseted.

DETAILED DESCRIPTION

Figures 1A, 1B, 1C:
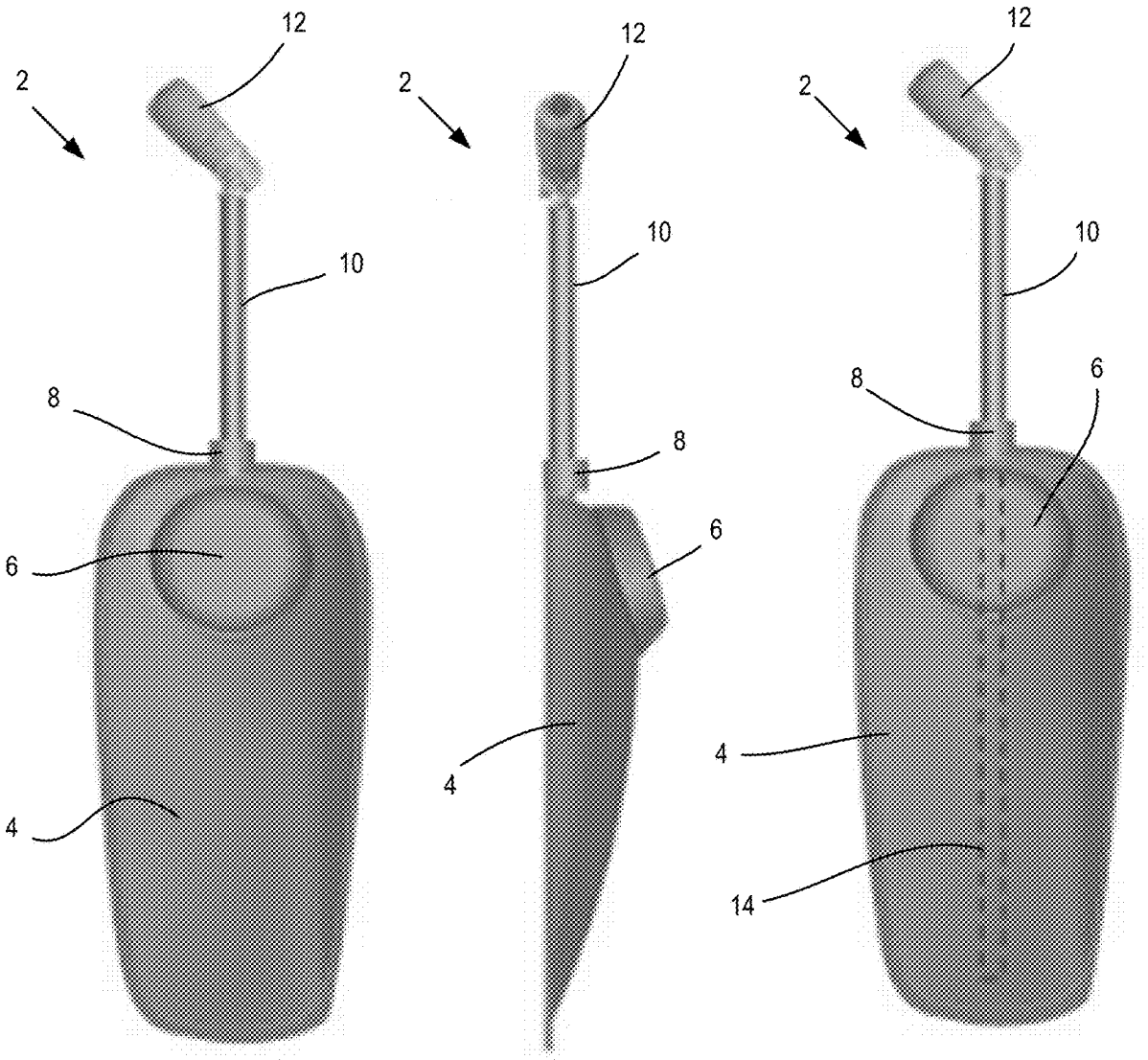
FIG. 1A shows is a front view of an exemplary bladder comprising a formed front sheet, flat back sheet, large screw port, seam-welded exit port, drink tube, and mouthpiece.
FIG. 1B shows a side view of FIG. 1A.
FIG. 1C illustrates how the drink tube may be positioned within the bladder to provide column strength and improved bladder emptying.

This following description proceeds with reference to the accompanying figures, which are filed herewith and form part of this application. Disclosed herein are embodiments of flexible fluid reservoirs that may include a front sheet and a rear sheet that may be fully or partially sealed around their mutual perimeters to form a bladder. In some embodiments, the front and/or rear sheet may be formed to create a 3-dimensional shape. The reservoirs may include at least a first fluid port in an upper portion of the reservoir and at least a second fluid port in the upper or a lower portion of the reservoir. The first fluid port may be relatively larger than the second port and can be used to fill the reservoir with fluid and/or solids (e.g., ice), dispense the contents from the reservoir, and/or to clean the reservoir by inserting objects into the reservoir. The second port can be used as an exit port, such as by coupling the exit port to a tube and/or outlet valve.

While the front and rear walls of a bladder-type reservoir are normally flexible to allow the bladder to expand and contract as the fluid volume changes, the reservoirs disclosed herein can include rigid structural portions in combination with flexible bladder wall portions to provide increased stiffness in desired portions of the reservoirs. Some disclosed reservoirs may include a rigid spout assembly that may be coupled to all or a portion of a top seam of the bladder and may include at least the first fluid port. The spout assemblies disclosed herein may also include a removable and resealable cap, such as a threaded screw-type cap, to open and close the first fluid port. Such rigid spout assemblies can provide a gripping portion to hold and manipulate the reservoir, can provide an enlarged surface area that connects to the top seam of the bladder to distribute forces applied between the bladder and the spout portion, can provide a desired size, shape and orientation of at least the first fluid port, can help counteract torque applied while twisting the cap, and/or can help shape and/or flatten the bladder.

Some embodiments of the disclosed reservoirs may include a generally oval-shaped spout assembly that may be coupled a top seam of a bladder, for example by welding. The spout assembly may include an outer frame, which may be welded to the top seam or top bladder opening, and a sealable insert. The sealable insert may be insertable and removable from the outer frame and/or may include lockable cam levers configured to seal the insert within the outer frame. The sealable insert may include one or both of a first fluid port and a second fluid port.

Additionally and/or alternatively, some embodiments may include a generally oval-shaped spout assembly having an outer frame and an insert. The insert may be removably locked and/or sealed within the outer frame via a tightening collar disposed around a first fluid port. The tightening collar may include at least two wing members disposed on opposing sides of the tightening collar. The outer frame may include at least two engagement members, such as slots, disposed on opposing sides of the outer frame configured to retain the at least two wing members. A second fluid port may be removably disposed within the first fluid port. A drink tube disposed within the second fluid port may act as a tether for a cap of the first fluid port.

Additionally and/or alternatively, some embodiments may include a spout assembly including an outer frame and an insert wherein the outer frame may be semi-flexible and/or tensionable. The outer frame may be anchored to a top bladder seam (via welding, bonding, and/or belt loops disposed along top seam of the bladder). The outer frame may be disposed within the belt loops and may be anchored to the top bladder seam via a cam lever. The cam lever may be tightened and/or loosened to secure or remove the insert. The insert may include at least a first fluid port.

Additionally and/or alternatively, some embodiments may include a spout assembly including at least a first fluid port and/or one or more handle anchors welded within the bladder top seam.

Additionally and/or alternatively, some embodiments may include a spout assembly that may be welded to a center of a bladder sheet. The bladder sheet may then be folded and sealed along perimeter. The spout assembly may include one or more foldable wings that may also be sealed to the bladder and/or may fold with the bladder and serve as grasping features. A foldable wing may include a hang loop mount and/or a connecting feature for a long handle.

Additionally and/or alternatively, some embodiments an reservoir can include a flexible bladder, a first fluid port and a second fluid port assembly including a cap for sealing a first fluid port. The reservoir can also include a strut member and a spout assembly including a cap for sealing a first fluid port. The first fluid port may include a threaded spout, such as in internally threaded spout. In some embodiments, the cap can include one or more grip features configured to assist with twisting the cap to seal the first fluid port or to remove the cap from the first fluid port. The cap can include a second fluid port disposed within it. The second fluid port can include an outlet valve, such as a bite-valve that can be operated by biting on the valve. The cap may include a base and the second fluid port can extend from the base such that the outlet valve opening extends towards or beyond a top portion of the bladder. In some embodiments, the cap and/or outlet valve can include an open position, in which fluid can flow from the bladder through the outlet valve, and an off position, in which fluid is blocked from flowing out of the outlet valve.

In some embodiments, the strut member can at least partially or completely be disposed around the cap and/or the first fluid port. In some embodiments, the strut member can be welded or bonded to the bladder. Alternatively, the strut member can be removably attached to the bladder. For example, the upper portion and the lower portion can be removably attached to the bladder via a snap fit mechanism. Additionally, the strut member may incorporate handling features such as a finger loop.

In some embodiments, all or a portion of the strut member can include an angle of curvature that can approximate the curvature of the bladder when filled with fluid. Alternatively, the strut member can be substantially planar. The strut member can have a width that is greatest at the top portion and a width that is narrowest at the middle portion.

In some embodiments, the spout assembly and/or the strut member may be disposed on a first side of the bladder. In some embodiments, the strut member can be disposed on the first side, top seam and the second side of the bladder. Additionally and/or alternatively, the spout assembly can be disposed on the top seam of the bladder. In some embodiments, the strut member may comprise all or part of one side of the bladder that is made with a relatively stiff film or similar stiff material.

In some embodiments, the bladder can include a first sheet, a second sheet, a top seam and/or a bottom gusset. The top seam can be substantially straight. The bottom gusset can include a gusset piece attached by welding, bonding or other known attachment means to the first sheet and the second sheet. The gusset piece can include a rectangular, triangle, rhombus and/or other gusset shape. In some embodiments, the reservoir can include a top gusset and/or a bottom gusset. The gusset can include a gusset piece having central fold such that excess material of the gusset piece folds inwards towards the center of the bladder. In some embodiments, the bladder can include a bottom opening and/or a top opening that can be removably sealed via a clip or a slider or other removably sealing means.

In some embodiments, the bladder can include a first sheet and a second sheet. The second sheet can include a substantially planar configuration. The first sheet can be larger than the second sheet. For example, the first sheet can include a three dimensional shape such that the spout assembly and/or strut member are elevated above the second sheet. The first sheet can be molded to include the three dimensional shape and/or the first sheet can be attached to the strut member, wherein the strut member is molded into a non-planar shape. The bladder can include a first depth at a top portion and a second depth at a bottom portion. The first depth can be greater than the second depth.

FIGS. 1-14

Figure 3:
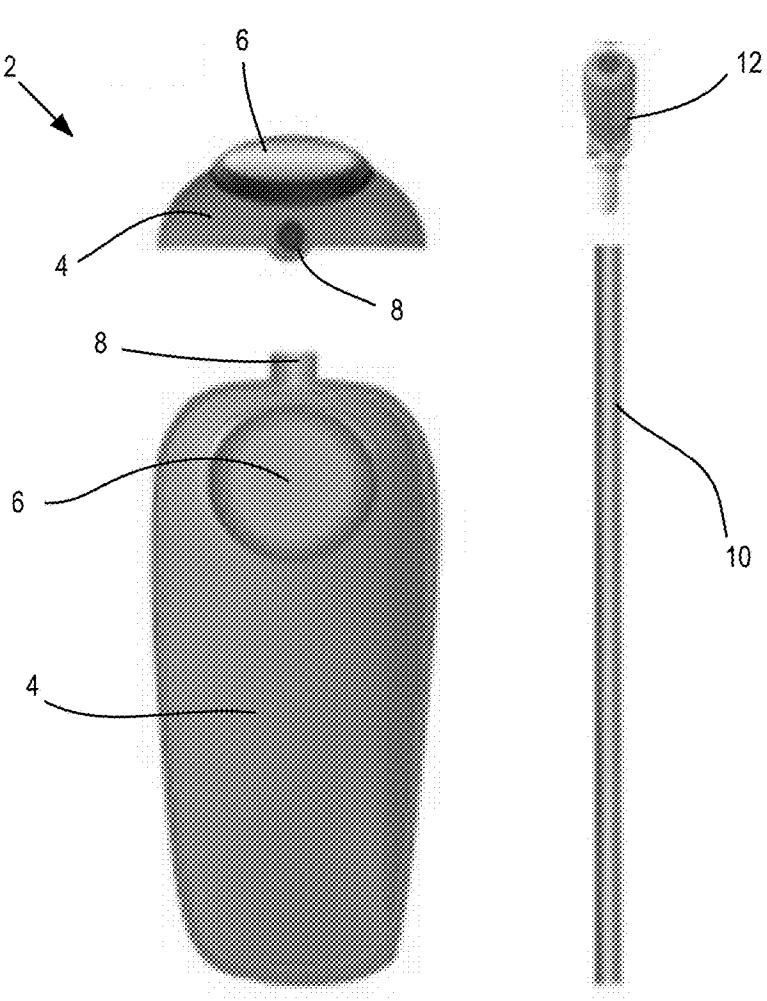
FIG. 3 shows top and front view of the bladder assembly.
Figure 2:
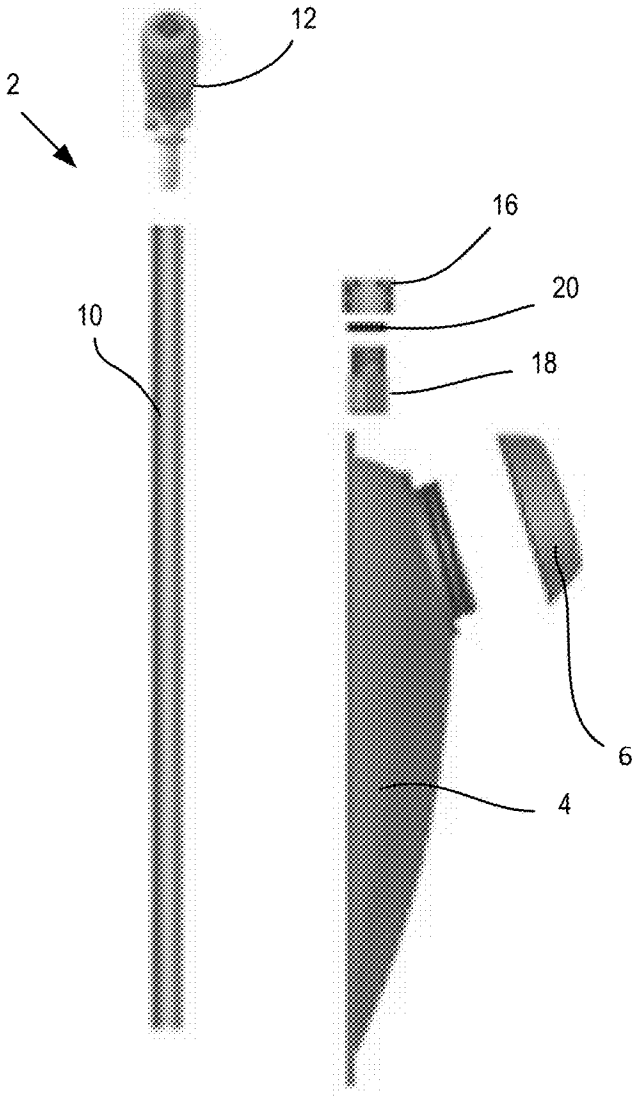
FIG. 2 depicts an assembly view of a FIG. 1A and includes formed front sheet, flat back sheet, large screw port and cap, seam-welded exit port with cap collar and o-ring, drink tube, and mouthpiece.

FIG. 1A shows is a front view of an exemplary bladder assembly 2 comprising a bladder 4 having a formed front sheet and a flat back sheet, large screw port with cap 6, seam-welded exit port 8, drink tube 10, and mouthpiece 12. FIG. 1B shows a side view of FIG. 1A. FIG. 1C illustrates how the drink tube 10 is longitudinally slidably adjustable relative to the exit port, and may be positioned within the bladder 4 (as shown by dashed lines 14), which can make it more compact, provide column strength, and/or improve bladder emptying. The tube 10 can comprise a material that is relatively more rigid than the bladder material, for example. FIG. 2 shows an assembly view of a FIG. 1A, showing the large screw port and cap 6, seam-welded exit port 8 comprising a base 18 mounted to the top seam of the bladder, a collar 16, and an o-ring 20 mounted therebetween. The tube 10 slides through the exit port and is sealed around the outside of the tube by the o-ring 20 to prevent fluid from leaking out through the exit port around the tube. The tube 10 has an extend position wherein a majority of the outlet tube is positioned outside of the internal reservoir, and the tube has a retracted position wherein a majority of the tube is inside the internal reservoir. FIG. 3 shows top and front views of the bladder assembly 2 with the tube 10 separate.

Figure 4:
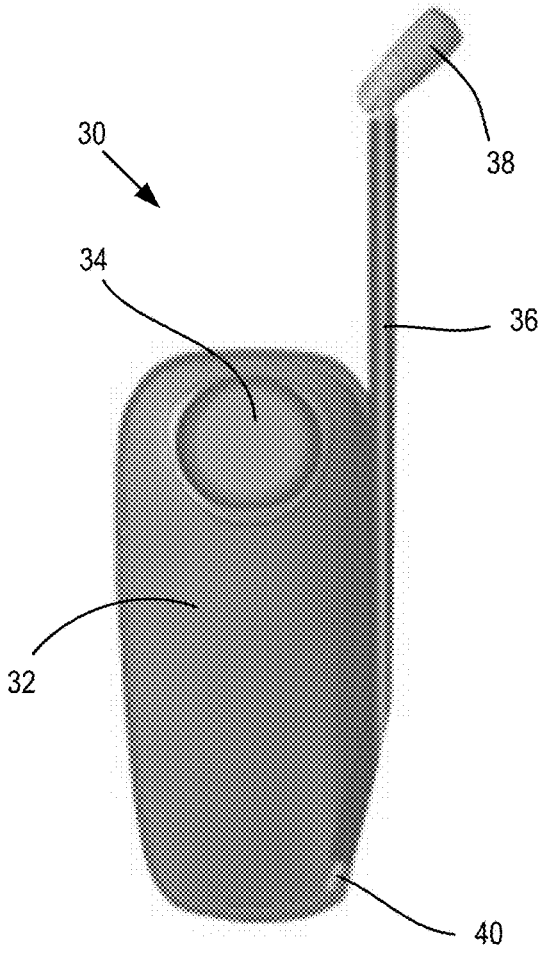
FIG. 4 illustrates the bladder featuring a side seam-welded exit port.

FIG. 4 illustrates a bladder assembly 30 featuring a side seam-welded exit port. The assembly comprises a flexible bladder 32 with a front positioned fluid port and cap 34, a side mounted drink tube 36 with mouthpiece 38 coupled to the side edge of the bladder and fluidly coupled to the fluid reservoir by exit port 40 positioned at the bottom side of the bladder. The tube 36 can pass through the side seam anywhere along the side seam between the top and bottom of the bladder.

Figure 5:
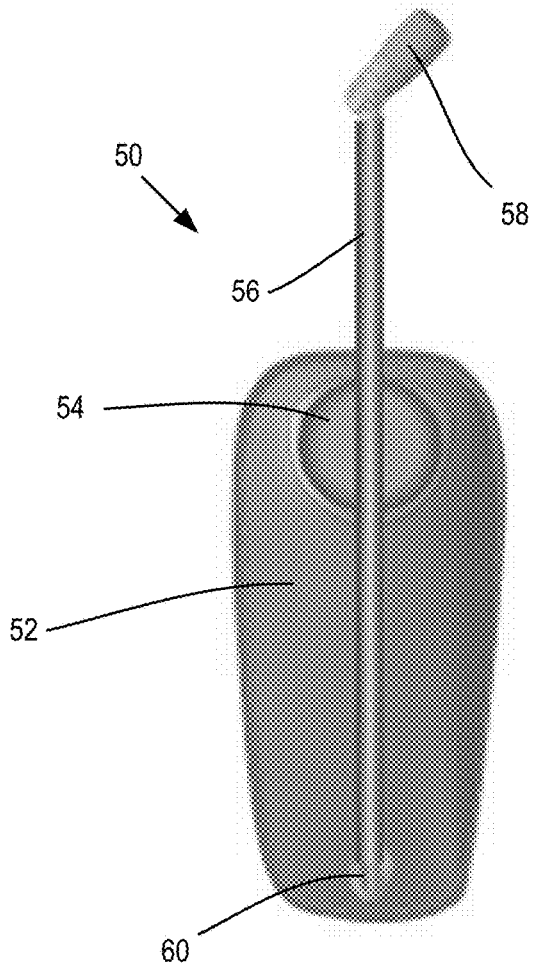
FIG. 5 shows the bladder with a face mounted exit port.

FIG. 5 shows a bladder assembly 50 with a face mounted exit port. The assembly comprises a flexible bladder 52 with a front positioned fluid port and cap 54, a front mounted drink tube 56 with mouthpiece 58 coupled to the front side of the bladder and fluidly coupled to the fluid reservoir by exit port 60 positioned at the bottom middle of the bladder. The tube 36 can be attached to the front of the bladder anywhere along the front between the top and bottom of the bladder.

Figure 6:
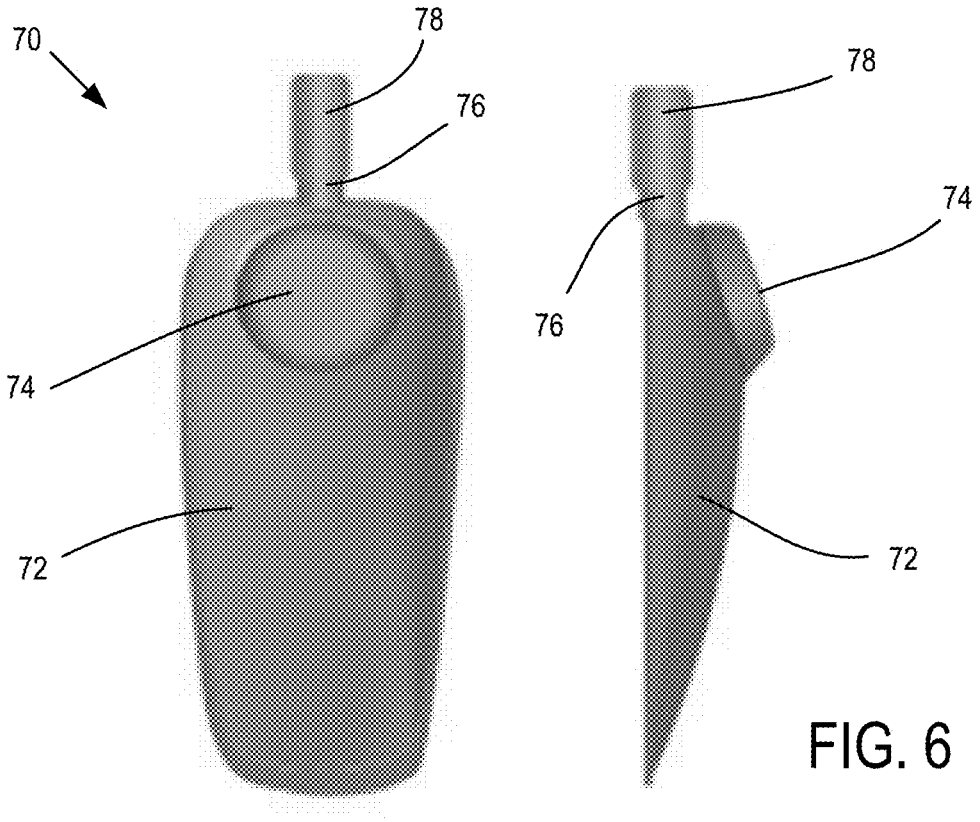
FIG. 6 shows the bladder with the mouthpiece attached directly to a seam-welded exit port.

FIG. 6 shows a bladder assembly 70 with the mouthpiece attached directly to a seam-welded exit port. The assembly comprises a flexible bladder 72 with a front positioned fluid port and cap 74, and a top mounted outlet port 76 with a mouthpiece 78 coupled directly to the outlet port. The outlet port 76 can be mounted in the top seam between the front and back of the bladder, or at the top of either the front or the back of the bladder.

Figure 7:
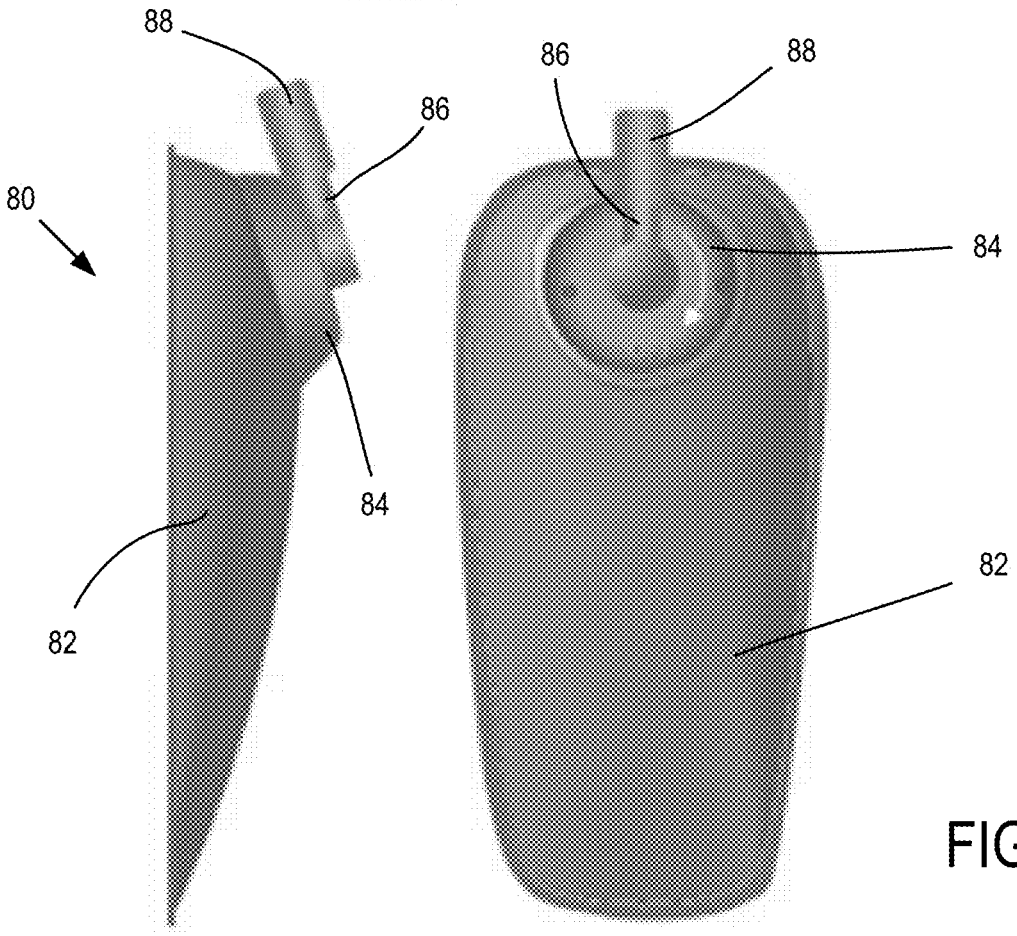
FIG. 7 depicts a bladder with a large screw-port and a second port integrated into the screw-port cap. In this embodiment, the second port is comprised of a rotatable exit port that has an open and closed position.

FIG. 7 shows a bladder assembly 80 comprising a bladder 82, a large screw-port and cap 84, and an outlet port 86 integrated into the screw-port cap 84. In this embodiment, the outlet port 86 is comprised of a rotatable exit port valve that has an open and closed position, and a mouthpiece 88 can be mounted directly to the outlet port. The exit port valve can rotate (e.g., 180 degrees) between open and closed positions, such that the mouthpiece also rotates along with it (e.g., mouthpiece points up when open, as illustrated, and points down when closed).

Figure 8:
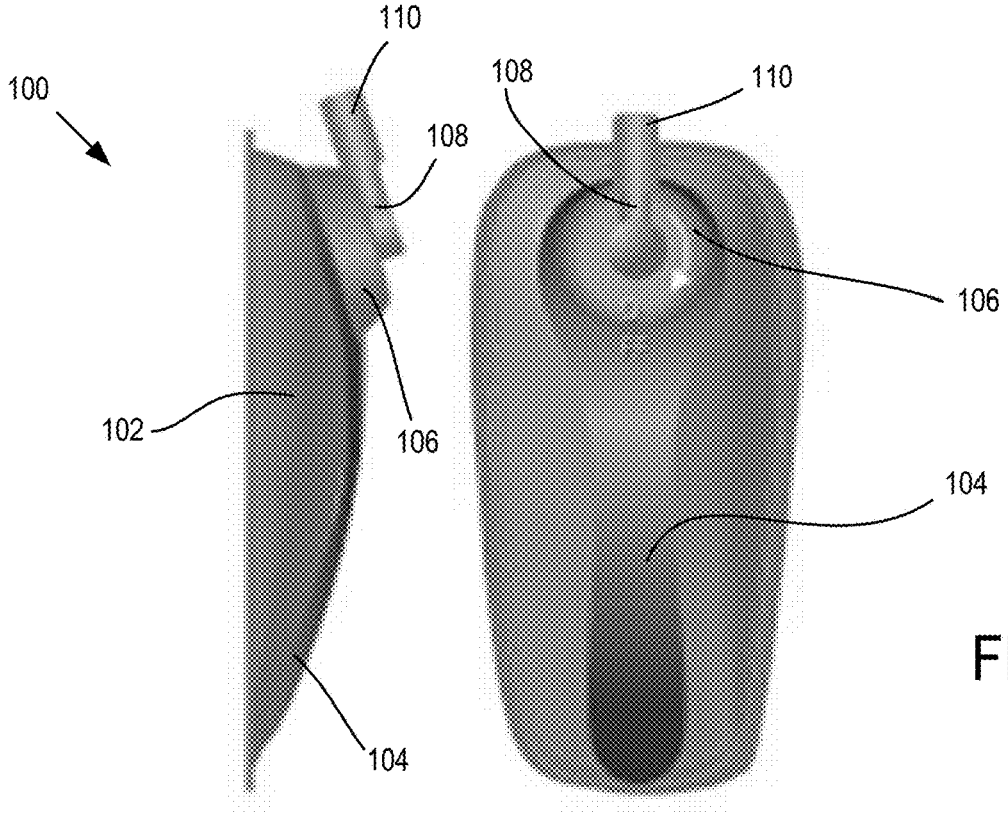
FIG. 8 shows a bladder featuring a formed front sheet, flat back sheet, screw-port, port-equipped screw-port cap and face-mounted strut.

FIG. 8 shows a bladder assembly 100 comprising a bladder 102 having formed front sheet and flat back sheet, a strut 104 mounted on the front sheet, a screw-port with screw-port cap 106, a rotatable outlet port valve 108 mounted on the cap (as in assembly 80), and a mouthpiece 110 coupled directly to the outlet port. The strut 104 and other strut embodiments disclosed herein, can comprise a material that is relatively more rigid than the bladder walls, such that the strut increases the rigidity of the bladder. The struts can be affixed to the outside surface of the bladder wall, such as by welding, adhesives, mechanical fixtures, etc. Such struts can also provide gripping locations for a user, such as for turning the screw cap, for cleaning the inside of the bladder, and for drinking from the bladder. The strut 104 is curved to conform to the shaped front sheet and has a larger top end that encompasses the screw port, a narrowed middle part, and a slightly larger lower end. The curved shape of the strut helps to hold the front wall of the bladder apart from the rear wall and maintains the overall shape of the bladder even when empty. The screw port can be integrated with the strut 104 as one continuous/monolithic piece of rigid material, or they can be two or more pieces coupled together.

Figure 9:
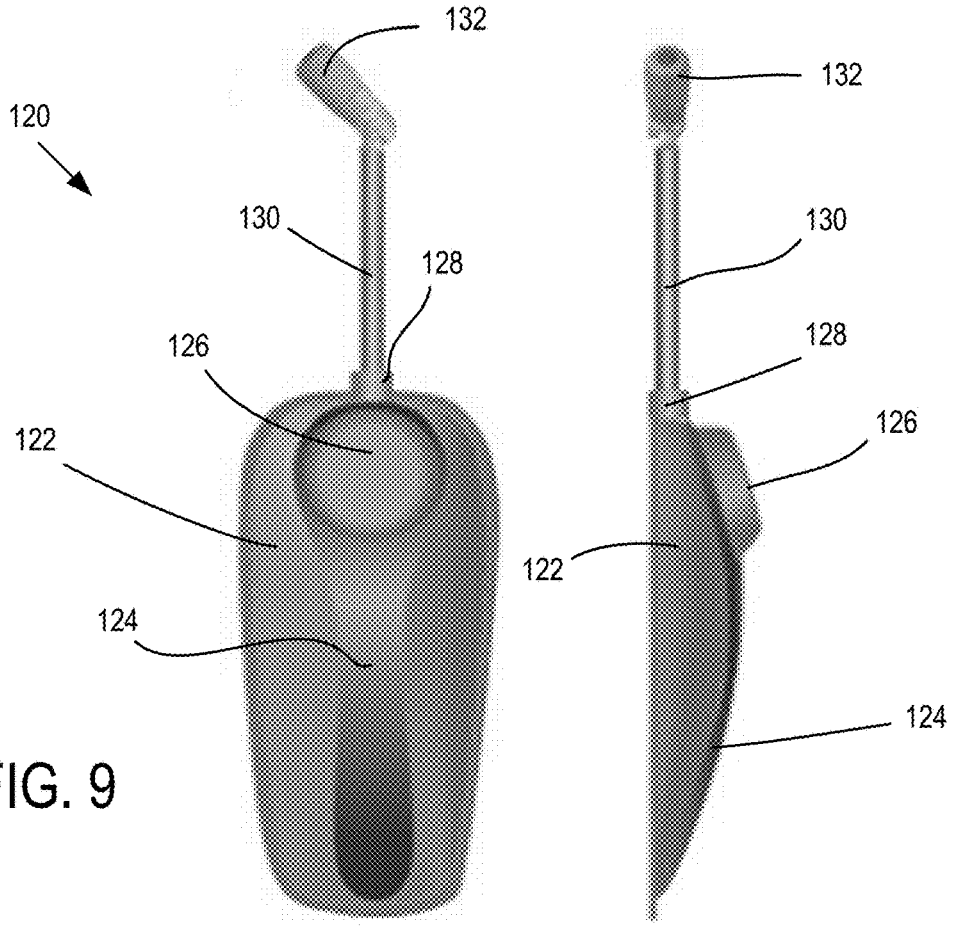
FIG. 9 illustrates a bladder comprised of formed front sheet, flat back sheet, large screw port, seam-welded exit port, drink tube, mouthpiece, and face-mounted strut.

FIG. 9 shows a bladder assembly 120 comprising a bladder 122 having formed front sheet and flat back sheet, a strut 124 mounted on the front sheet, a screw-port with screw-port cap 126, a top seam mounted exit port 128, a drink tube 130, and a mouthpiece 132 coupled to the drink tube. The strut 124 is curved to conform to the shaped front sheet and has a larger top end that encompasses the screw port, a narrowed middle part, and a slightly larger lower end. The screw port can be integrated with the strut 104 as one continuous/monolithic piece of rigid material. The drink tube 130 can slide down to be positioned within the bladder 122 (as in FIG. 1C), which can make it more compact, provide column strength, and/or improve bladder emptying.

Figure 12:
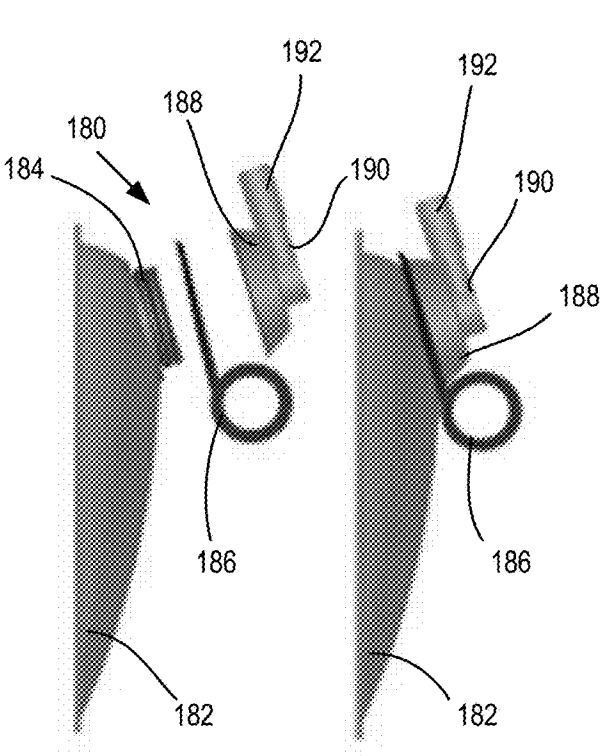
FIG. 12 shows an assembly view of a bladder with screw-port and seam-welded exit port with an attachable finger loop.
Figure 11:
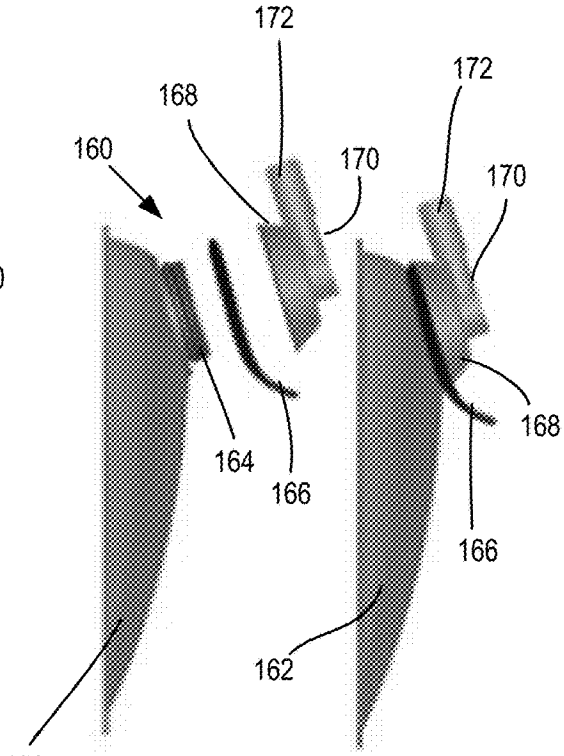
FIG. 11 depicts an assembly view of a bladder with screw-port and seam-welded exit port with an attachable handle.
Figure 10:
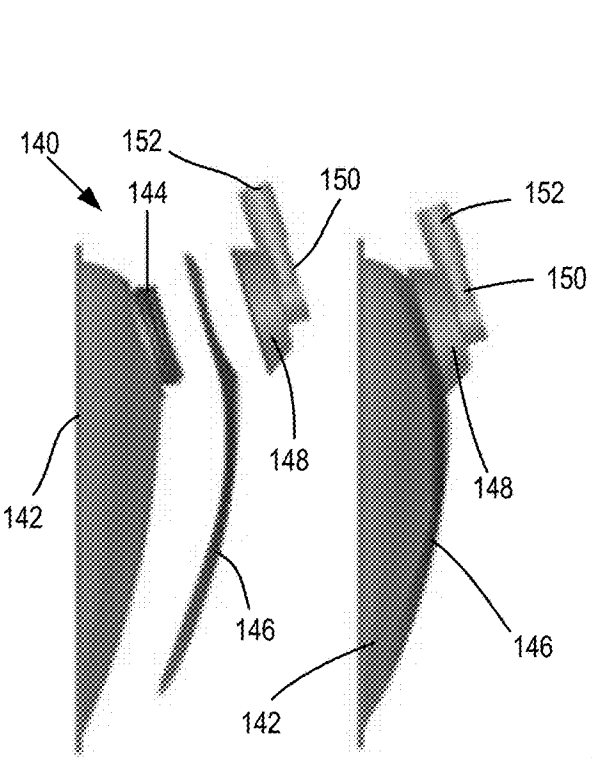
FIG. 10 shows an assembly view of a bladder with a screw-port, exit port equipped cap, and attachable strut.

FIGS. 10-12 show bladder assembly embodiments that are similar to assembly 100, but with differently shaped front struts that are attachable and detachable.

FIG. 10 shows a bladder assembly 140 comprising a bladder 142 having formed front sheet and flat back sheet, a screw port 144 coupled to the front sheet, a detachable front strut 146 that mounts around the screw port, a screw port cap 148 with a rotatable outlet port valve 150, and a mouthpiece 152 coupled directly to the outlet port. The strut 146 is curved to conform to the shaped front sheet and has a larger top end that extends around the screw port. The screw port cap 148 can hold the strut 146 in place on the front of the bladder when the cap is screwed tightly onto the screw port 144.

FIG. 11 shows a bladder assembly 160 comprising a bladder 162 having formed front sheet and flat back sheet, a screw port 164 coupled to the front sheet, a detachable front strut or handle 166 that mounts around the screw port, a screw port cap 168 with a rotatable outlet port valve 170, and a mouthpiece 172 coupled directly to the outlet port. The handle 166 has a ring shaped top end that extends around the screw port 164 and a lower projection that extends away from the bladder to serve as a handle. The screw port cap 168 can hold the handle 166 in place on the front of the bladder when the cap is screwed tightly onto the screw port 164.

FIG. 12 shows a bladder assembly 180 comprising a bladder 182 having formed front sheet and flat back sheet, a screw port 184 coupled to the front sheet, a detachable front strut or handle 186 that mounts around the screw port, a screw port cap 188 with a rotatable outlet port valve 190, and a mouthpiece 192 coupled directly to the outlet port. The handle 186 has a ring shaped top end that extends around the screw port 184 and a lower finger loop that extends away from the bladder to serve as a handle. The screw port cap 188 can hold the handle 186 in place on the front of the bladder when the cap is screwed tightly onto the screw port 184.

Figure 13:
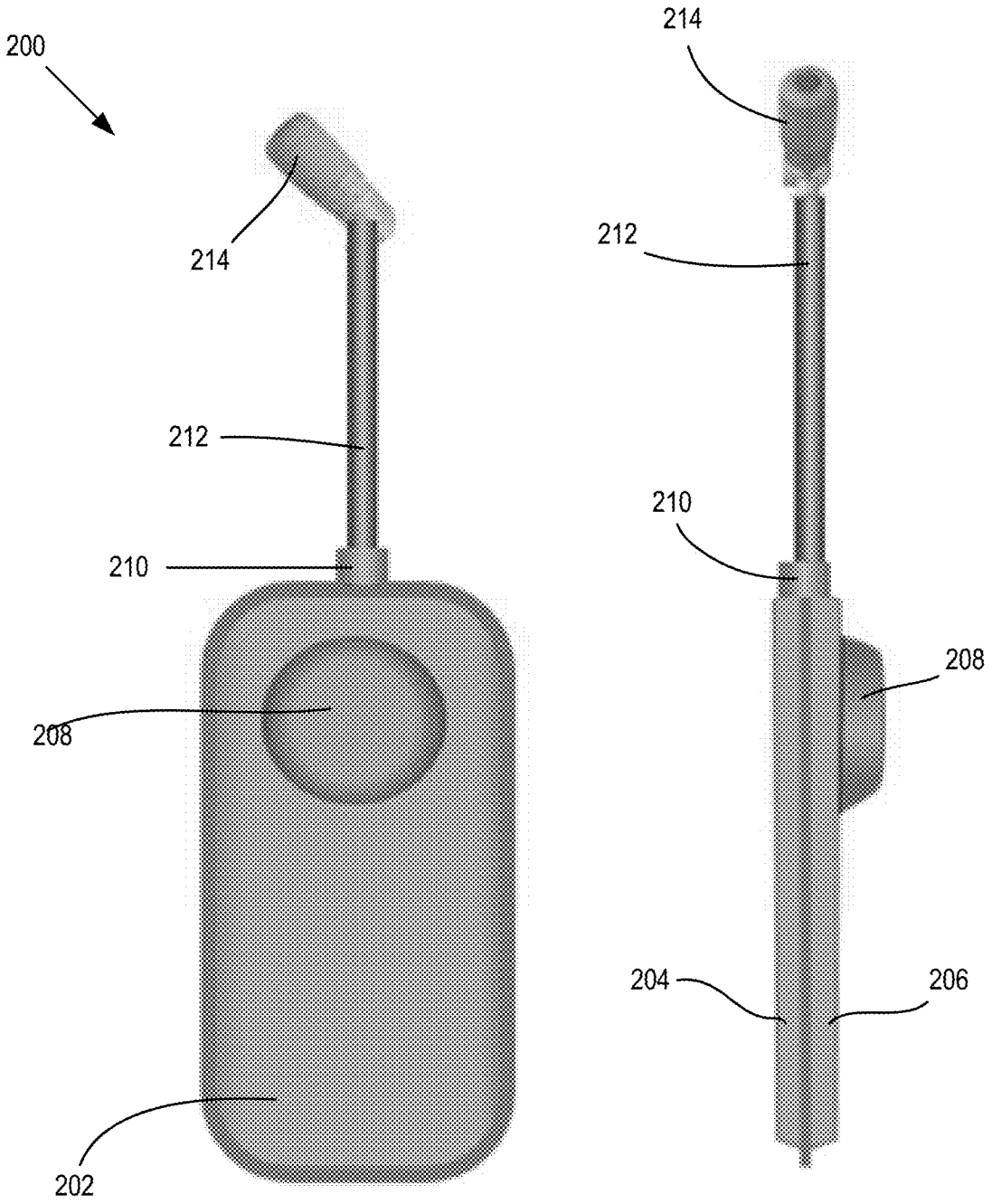
FIG. 13 shows a front view of a bladder comprising a formed front sheet, formed back sheet, large screw port, seam-welded exit port, drink tube, and mouthpiece.

FIG. 13 shows a bladder assembly 200 comprising a bladder 202 having formed back sheet 204 as well as a formed front sheet 206, a screw-port with screw-port cap 208, a top seam mounted exit port 210, a drink tube 212, and a mouthpiece 214 coupled to the drink tube. The drink tube 212 can slide down to be positioned within the bladder 202 (as in FIG. 1C), which can make it more compact, provide column strength, and/or improve bladder emptying. Both the formed back sheet 204 and the formed front sheet 206 can comprise a semi-rigid material that maintains its form with filled or empty, and either formed sheet can have any desired shape, such as primarily flat walled (as shown), rounded (as in FIG. 1B), angular, and/or other shapes.

Figure 14:
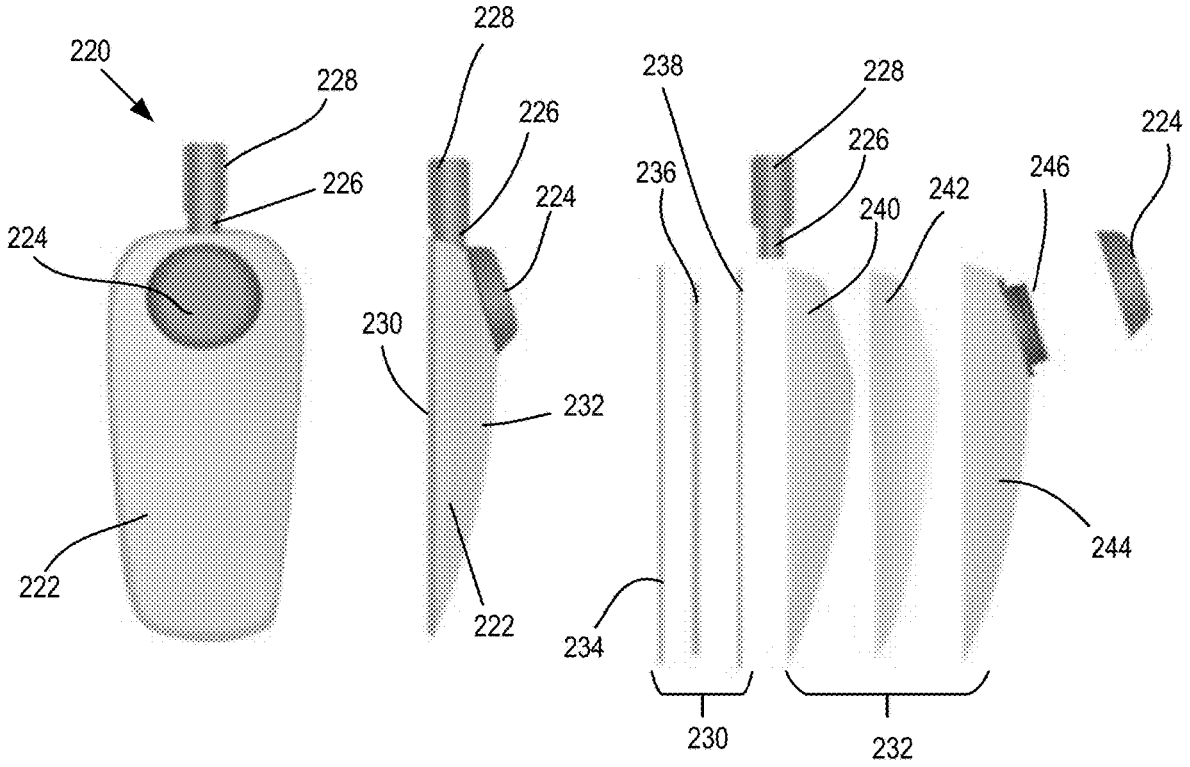
FIG. 14 shows an insulated bladder embodiment where the front and rear walls of the bladder comprise multiple layers including an insulation layer.

FIG. 14 shows front, side, and assembly views of a bladder assembly 220 that comprises an insulated bladder 222 that includes a flat back wall 230 comprising an insulation layer 236 between two sheets 234, 238, and comprises a formed front wall 232 comprising an insulation layer 242 between two sheets 240, 244. The insulation layers can comprise any material that provide the wall with a relatively low thermal conductivity compared to conventional polymeric bladder walls (e.g., rubber, foam, metallic film, fibrous materials, etc.) Such insulated walls can have any thickness, and they can be incorporated into any of the bladder assembly embodiments disclosed herein.

FIGS. 15-42

Figure 15:
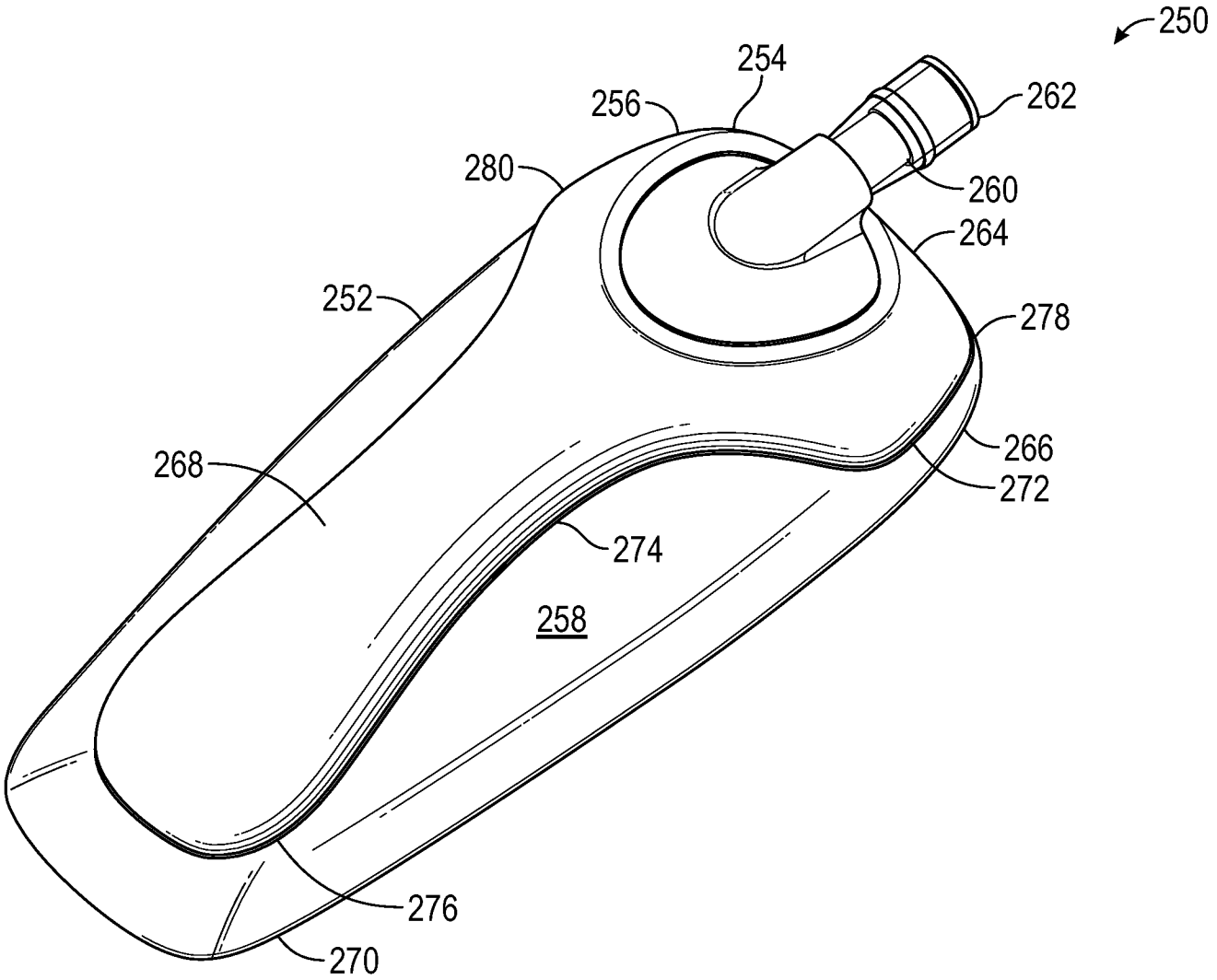
FIG. 15 shows a bladder comprising a rigid strut member and a fluid port cap that includes a fluid outlet port.

FIG. 15 illustrates an exemplary reservoir 250 that includes a flexible bladder 252 and a spout assembly 254 including a cap 256 for sealing a first fluid port (not shown). The spout assembly 254 may be disposed on a first side 258 of the bladder. The first fluid port may include an internally threaded spout (not shown). The cap 256 can include one or more grip features, such as a textured surface, configured to assist with twisting the cap 256 to seal the first fluid port or to remove the cap 256 from the first fluid port. The cap 256 can include a second fluid port 260 disposed within it. The second fluid port 260 can include an outlet valve 262, such as a bite-valve that can be operated by biting on the valve. The cap 256 may include a base 264 and the second fluid port 260 may extend from the base such that the outlet valve 262 opening extends towards or beyond a top portion 266 of the bladder 252.

The reservoir 250 can additionally and/or alternatively include a strut member 268 that can extend along the first side 258 of the bladder 252. For example, the strut member 268 can extend from the top portion 266 to a bottom portion 270 of the bladder. Additionally and/or alternatively, the strut member 268 can be disposed between the top and bottom portions 266, 270 of the bladder 252. All or some portions of the strut member 268 can include a greater stiffness than the bladder 252. In some embodiments, the strut member 268 can include means to decrease weight of the strut member 268, such as perforations. Additionally and/or alternatively, the strut member 268 can include slots configured to receive and/or retain a hand strap.

The strut member 268 can include an upper portion 272, a middle portion 274 and a lower portion 276. The upper portion 272 can at least partially or completely be disposed around the cap 256 and/or the first fluid port. Additionally and/or alternatively, the lower portion 276 can be disposed adjacent the bottom portion 270 of the bladder 252. In some embodiments, the upper portion 272 and the lower portion 276 can be welded to the bladder 252. Additionally and/or alternatively, the entire length of the strut member 268 can be welded to the bladder 252. Alternatively, the strut member 268 can be removably attached to the bladder 252. For example, the upper portion 272 and the lower portion 276 can be removably attached to the bladder 252 via a snap fit mechanism. In some embodiments, the bladder 252 may include an internal seam along one or more sides of the bladder 252.

In some embodiments, all or a portion of the strut member 268 can include an angle of curvature that can approximate the curvature of the bladder 252 when filled with fluid. For example, the upper portion 272 can include an angle of curvature having a peak 280 adjacent to a portion of the cap 256 and/or the first fluid port that is distal to a top seam 278 of the bladder 252. The middle and/or lower portion 274, 276 of the strut member 268 can extend from the top portion 272 at a downwardly extending slope. In some embodiments, the curvature of the strut member 268 and the placement of the strut member 268 relative to the bottom portion 270 of the bladder 252 and the first fluid port can apply pressure on some or all of any fluid in the bladder 252 towards the first fluid port.

As noted above, the upper portion 272 can be disposed around the cap 256 and/or the first fluid port. The upper portion 272 can include grip areas on opposing sides of the cap and/or the first fluid port. The strut member 268 may be configured for grasping about the middle portion 274. For example, the strut member 268 can have varying widths. The strut member 268 can have a width that is greatest at the top portion 272 and a width that is narrowest at the middle portion 274.

Figure 16:
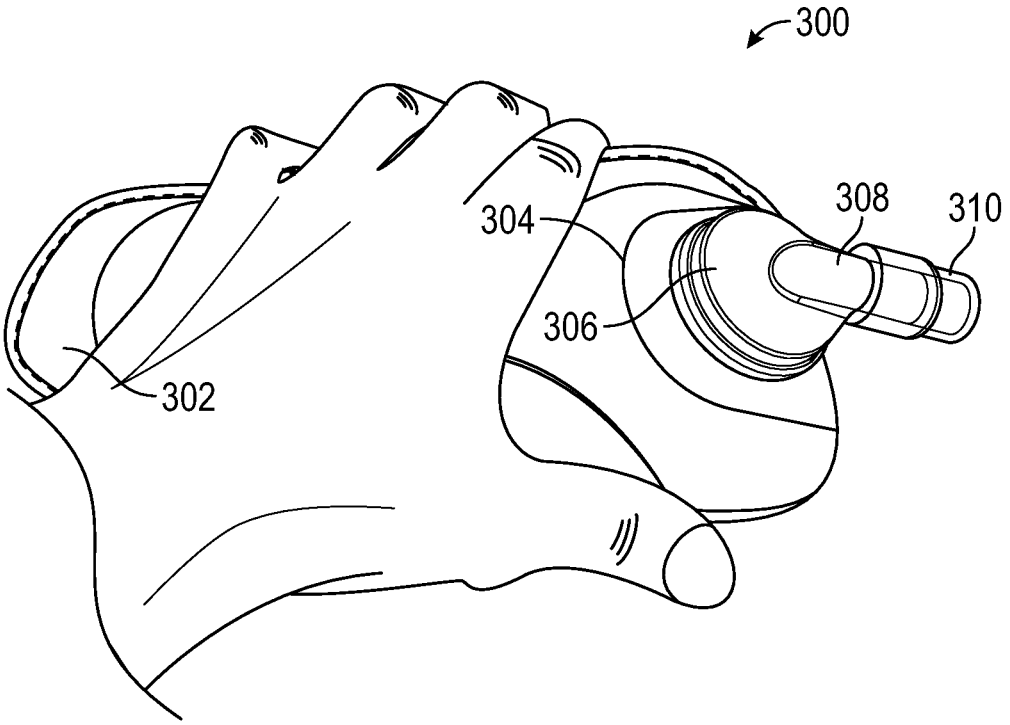
FIGS. 16 and 17 show a bladder comprising a rigid strut member and a fluid port cap that includes a fluid outlet port.
Figure 17:
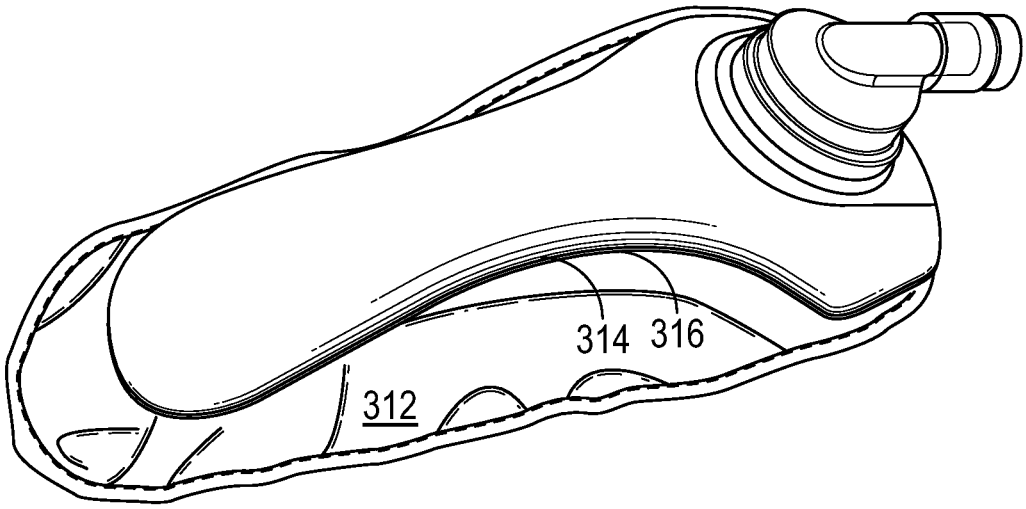

FIGS. 16 and 17 illustrate a reservoir 300 similar to the reservoir 200 in FIG. 15, having a flexible bladder 302 and a spout assembly 304 including a cap 306 for sealing a first fluid port (not shown). The cap 306 can include a second fluid port 308 disposed within it. The second fluid port 308 can include an outlet valve 310. The reservoir 300 can additionally and/or alternatively include a strut member 314 that can extend along a first side 312 of the bladder 302. All or some portions of the strut member 314 can include a greater stiffness than the bladder 302. In some embodiments, the strut member 314 can be configured to be griped by a single hand as shown in FIG. 16. In some embodiments, the strut member 314 can have a narrowest width at a middle portion 316.

Figure 20:
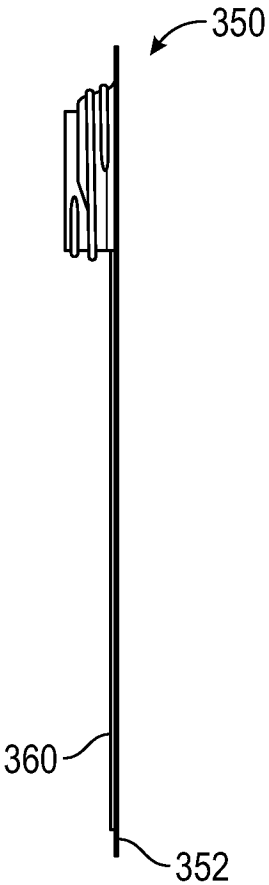
FIGS. 18-20 show orthogonal views of a bladder comprising a rigid strut member having articulating side portions that help a user grip the bladder.
Figure 19:
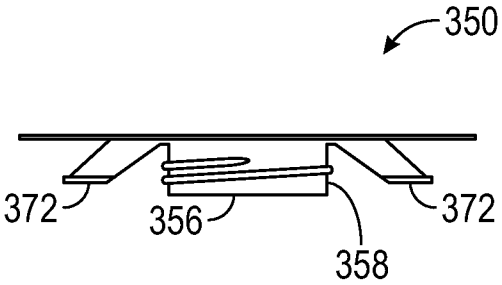
Figure 18:
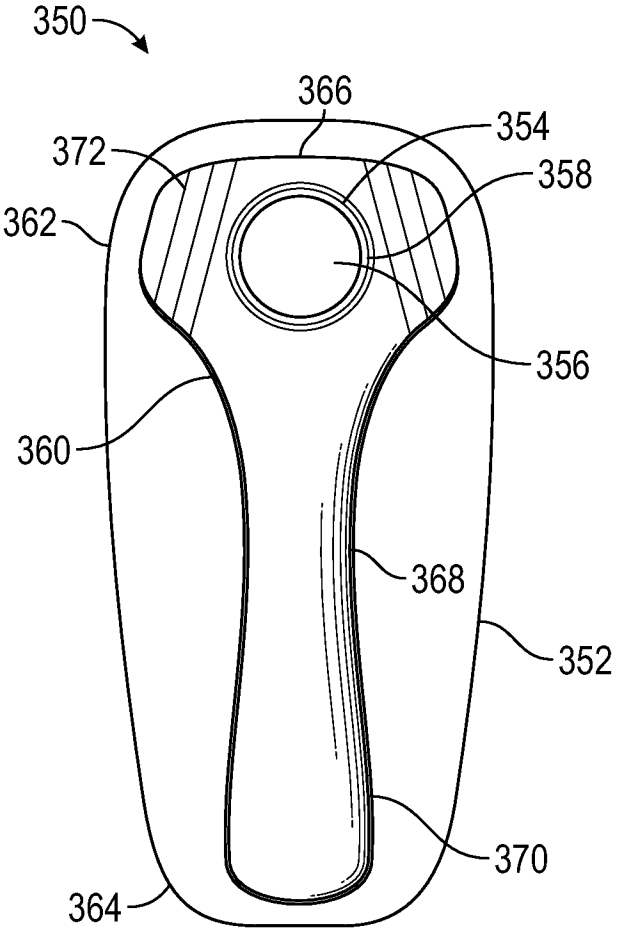

FIG. 18-20 illustrate an exemplary reservoir 350 that includes a flexible bladder 352 and a spout assembly 354 including a first fluid port 356. The first fluid port 356 can be configured to be removably sealed by a removable cap (not shown) and can include an externally threaded spout 358. In some embodiments, the cap can include a second fluid port disposed within it. The second fluid port can include an outlet valve, such as a bite-valve.

The reservoir 350 can additionally and/or alternatively include a strut member 360 that can extend along a first side of the bladder 352. For example, the strut member 360 can extend from a top portion 362 to a bottom portion 364 of the bladder 352. All or some portions of the strut member 360 can include a greater stiffness than the bladder 352. In some embodiments, the threaded spout 358 can be integral to the strut member 360 and/or can extend from a top surface of the strut member 360.

The strut member 360 can include an upper portion 366, a middle portion 368, and a lower portion 370. The upper portion 366 can at least partially or completely be disposed around the first fluid port 356. Additionally and/or alternatively, the lower portion 370 can be disposed adjacent the bottom portion 364 of the bladder 352. In some embodiments, the upper portion 366 and the lower portion 370 can be welded to the bladder 352. Additionally and/or alternatively, the entire length of the strut member 360 can be welded to the bladder 352. Alternatively, the strut member 360 can be removably attached to the bladder. For example, the upper portion 366 and the lower portion 370 can be removably attached to the bladder 352 via a snap fit mechanism.

In some embodiments, all or a portion of a bottom surface of the strut member 360 can be sustainably flat. For example, the middle and/or lower portion 368, 370 of the strut member 360 can extend along a sustainably straight line that is parallel to the bladder 352 when the bladder 352 is empty and/or the first fluid port 356. In some embodiments, the top portion 366 can be substantially parallel to the bladder 352 when the bladder 352 is empty and/or the first fluid port 358 in an area of the top portion that surrounds the first fluid port 356.

As noted above, the upper portion 366 can be disposed around the first fluid port 356. The upper portion 366 can include grip portions 372 on opposing sides of the first fluid port 356. The grip portions 372 may extend from the surface of the bladder 352. For example, the gripping portions 372 can extend such that the grip portions 372 are at an angle with respect to the first fluid port 356 and/or the grip portions 372 can terminate at approximately a distal end of the spout 358.

Figure 23:
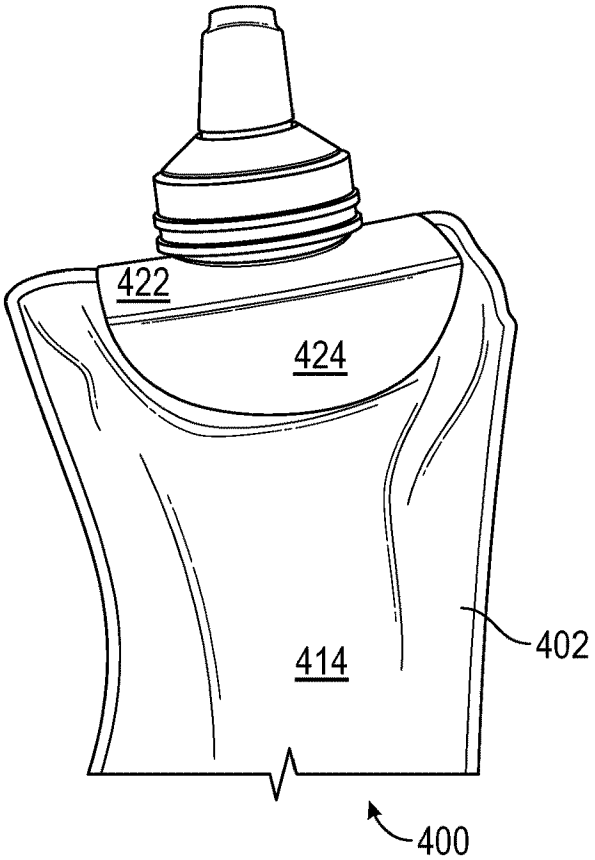
FIGS. 21-23 shows various views of a bladder comprising a rigid strut member that extends from one side of the bladder around the top to the other side of the bladder, with a fluid port at the top.
Figure 22:
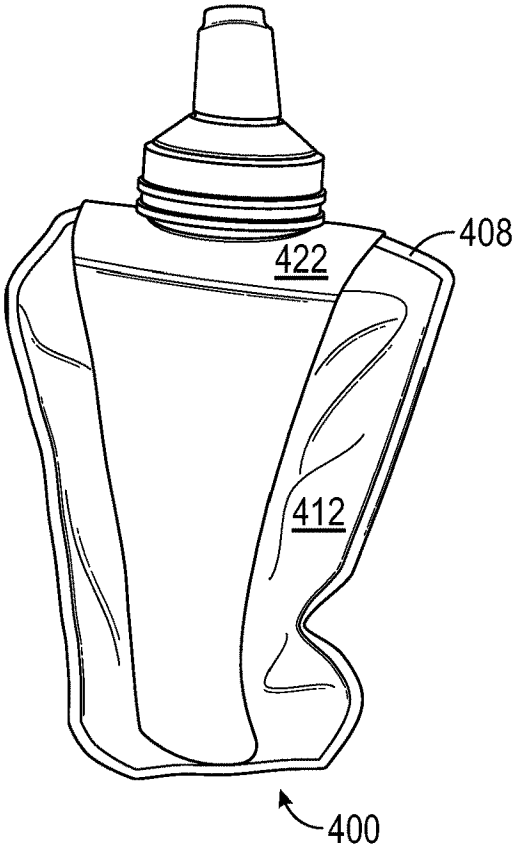
Figure 21:
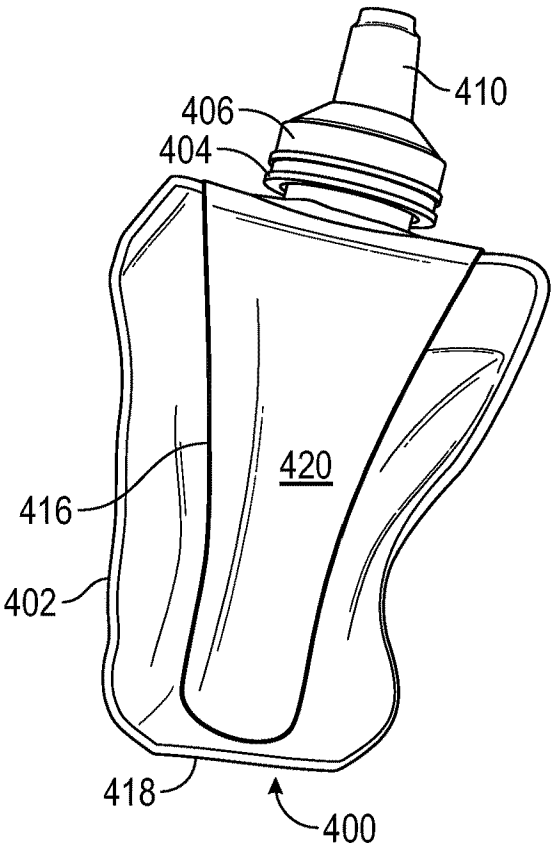

FIGS. 21-23 illustrate an exemplary reservoir 400 that includes a flexible bladder 402 and a spout assembly 404 including a cap 406 for sealing a first fluid port (not shown). The spout assembly 404 may be disposed within a top seam 408 of the bladder 402. The first fluid port may include a threaded spout (not shown). The cap 406 can include a second fluid port 408 disposed within it. The second fluid port 410 can include an outlet valve. The second fluid port 410 may extend from the cap 406 such that the second fluid port 408 extends beyond a top portion of the bladder 202.

The reservoir 200 can additionally and/or alternatively include a strut member 416 that can extend along a first side 412, over a top seam 408, and/or a second side 414 of the bladder 402. For example, the strut member can extend from a bottom portion of the first side to a top portion of the second side. Alternatively, the strut member 416 can be disposed on the top seam 408 of the bladder and terminate adjacent the top portions of the first and second sides 412, 414. The strut member 416 can include tapered shape having a greatest width adjacent the top portion on the first side 412 and a narrowest width adjacent to the bottom portion on the first side 412. In some embodiments, the bladder 402 can include a tapered shape having a greatest width adjacent the top seam 408 and a narrowest width adjacent a bottom seam 418.

The strut member 416 can at least partially or completely be disposed around the cap 402 and/or the first fluid port. In some embodiments, the strut member 416 can include a first portion 420 on the first side 412 of the bladder, a second portion 422 on the top seam 408 of the bladder and a third portion 424 on the second side of the bladder. One or both of the first and third portions 420, 424 may extend at approximately a 90 degree angle with respect to the second portion 422. The second fluid port 408 can extend perpendicular to a top surface of the second portion 422 of the strut member. In some embodiments, the first fluid port, the threaded spout, the second fluid port and/or the outlet valve can be aligned along the same axis.

Figure 24:
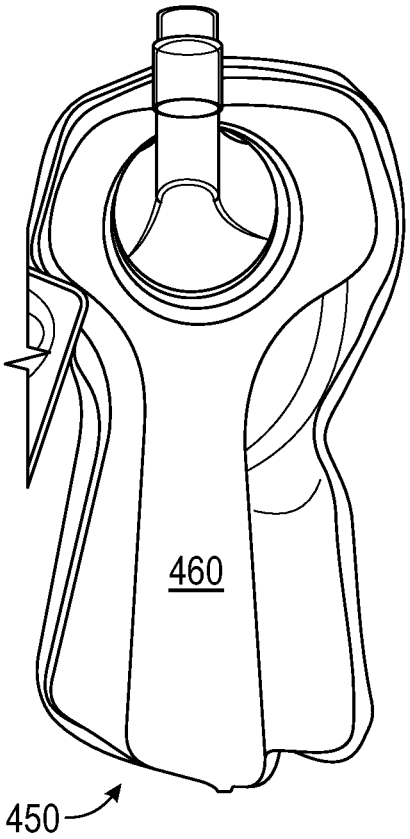
FIGS. 24-26 show various views of a bladder comprising a rigid strut member that forms a T shape on one side of the bladder, with a fluid port on that side of the bladder.
Figure 25:
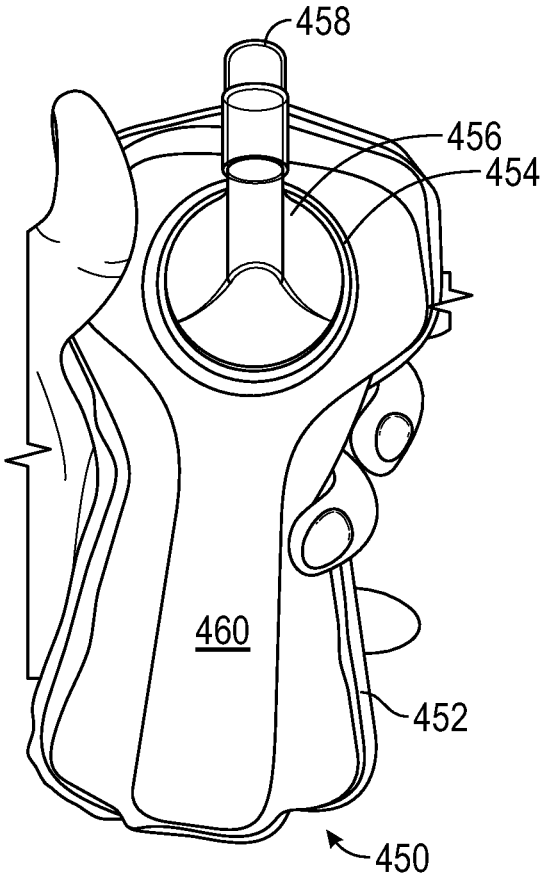
Figure 26:
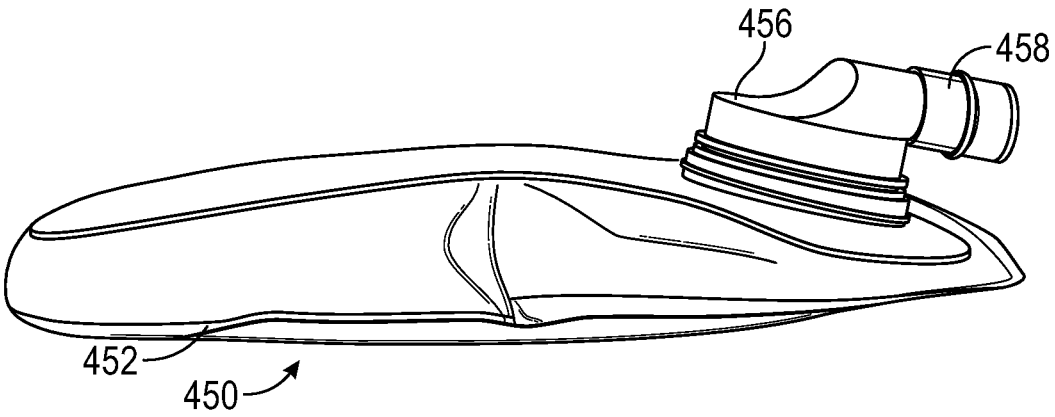

FIGS. 24-26 illustrate an exemplary reservoir 450 that includes a flexible bladder 452 and a spout assembly 454 including a cap 456 for sealing a first fluid port (not shown). The spout assembly 454 may be disposed on a first side of the bladder 452. The first fluid port may include a threaded spout (not shown). The cap 456 can include a second fluid port 458 disposed within it. The second fluid port 458 can include an outlet valve. The second fluid port 458 may extend perpendicular with respect to a top surface of the cap 454 such that the second fluid port 458 extends adjacent to and/or beyond a top portion of the bladder 452.

The reservoir 450 can additionally and/or alternatively include a strut member 460 disposed on the first side of the bladder 452. The strut member can include a T shape having a greatest width adjacent a top portion of the bladder 452 and a narrowest width adjacent to a bottom portion on the bladder 452. In some embodiments, the bladder 452 can include a corseted shape having a narrowest width adjacent a middle portion of the bladder 452.

Figure 27A:
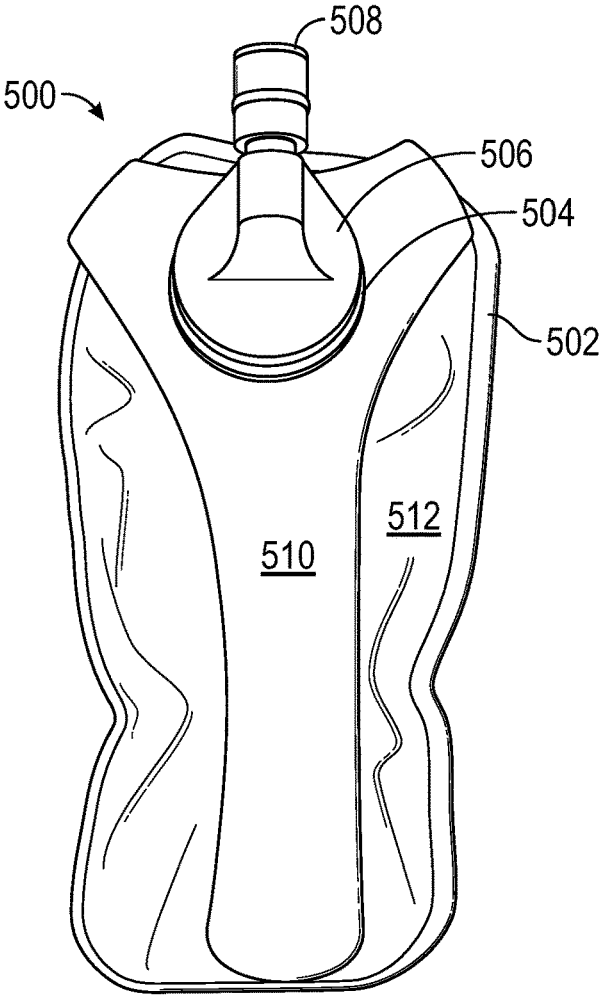
FIGS. 27A-27C shows various views of a bladder comprising a Y shaped rigid strut member on one side and a gusseted bottom.
Figure 27B:
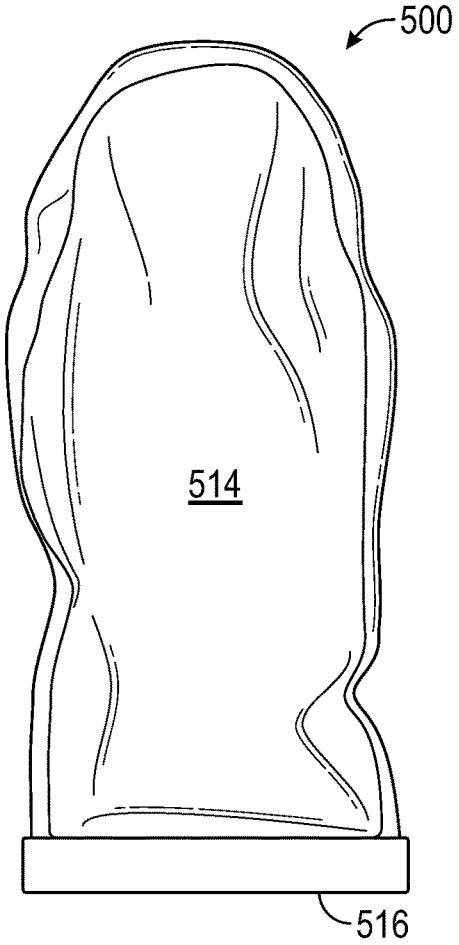
Figure 27C:
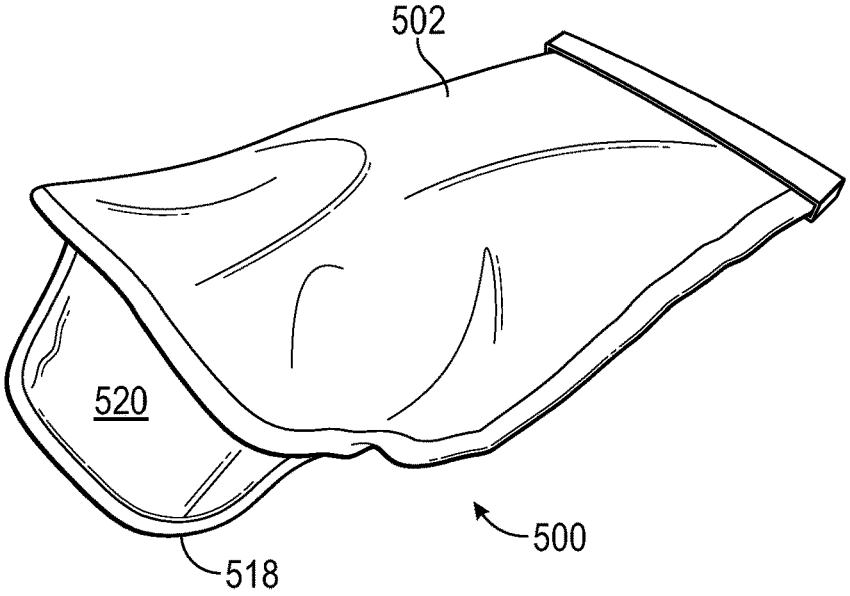

FIGS. 27A-27C illustrate an exemplary reservoir 500 that includes a flexible bladder 502 and a spout assembly 504 including a cap 506 for sealing a first fluid port (not shown). The cap 506 can include a second fluid port 508 disposed within it. The reservoir 500 can additionally and/or alternatively include a strut member 510 disposed on the first side of the bladder 502. For example, the strut member 510 can extend from a bottom portion of the first side to a top portion of the first side. The strut member 510 can include a Y shape having a greatest width adjacent the top portion and a narrowest width adjacent to the bottom portion on the first side. One or more of a plurality of ends of the strut member 510 can extend approximately to a seam of the bladder 502.

In some embodiments, the bladder 502 can include a first sheet 512, a second sheet 514, a top seam 516 and/or a bottom gusset 518. The top seam 516 can be substantially straight. The bottom gusset 518 can include a gusset piece 520 attached by welding, bonding or other known attachment means to the first sheet 512 and the second sheet 514. The gusset piece 520 can include a rectangular, triangle, rhombus and/or other gusset shape.

FIGS. 28-32 illustrate various bladder options for reservoirs in accordance with the present disclosure. For example, as illustrated in FIG. 28, a reservoir 550 can include a flexible bladder 552, a strut member 554 and a spout assembly 556 including a cap 558 for sealing a first fluid port (not shown). The spout assembly 556 and/or the strut member 554 may be disposed on a first side of the bladder 552. The first fluid port may include a threaded spout (not shown). The cap 558 can include a second fluid port 560 disposed within it. The strut member 554 can include a first portion 562 having a substantially irregular hexagon shape and a second portion 564 extending from the first portion having a substantially rectangular shape. The bladder 552 can include a first sheet 566 and a second sheet substantially coextensive with the first sheet 566. The first and/or second sheet can include a substantially rectangular shape having rounded corners. The first sheet 566 can be welded, bonded or otherwise coupled to the second sheet along corresponding edges.

As illustrated in FIGS. 29-30, a reservoir 600 can include a flexible bladder 602, a strut member 604 and a spout assembly 606 including a cap 608 for sealing a first fluid port (not shown), similar to the reservoir illustrated in FIG. 28. The bladder 602 can include a first sheet 610, a second sheet 612 and a gusset 614. The gusset 614 can be at a top portion of the bladder 602 as illustrated in FIGS. 29-30 or at a bottom portion. The gusset 614 can be configured to elevate the spout assembly 606 over the second sheet 612 and/or the bottom portion of the bladder 602. The first and/or second sheet 610, 612 can include a substantially rectangular shape having rounded corners. In some embodiments, the second sheet 612 can be substantially coextensive with the first sheet 610. The gusset 614 can include a gusset piece 616 having central fold 618 such that excess material of the gusset piece 616 folds inwards towards the center of the bladder 602.

As illustrated in FIGS. 31-32, a reservoir 650 can include a flexible bladder 652, a strut member 654 and a spout assembly 656 including a cap 658 for sealing a first fluid port (not shown), similar to the reservoir illustrated in FIG. 28. The bladder 652 can include a first sheet 660, a second sheet 662 and two or more gussets. For example, the bladder can include a top gusset 664 and a bottom gusset 666. The top gusset 664 and/or the bottom gusset 666 can include a gusset piece 668 having central fold 670 such that excess material of the gusset piece 668 folds inwards towards the center of the bladder 652.

Figures 33, 34, 35, 36, 37:
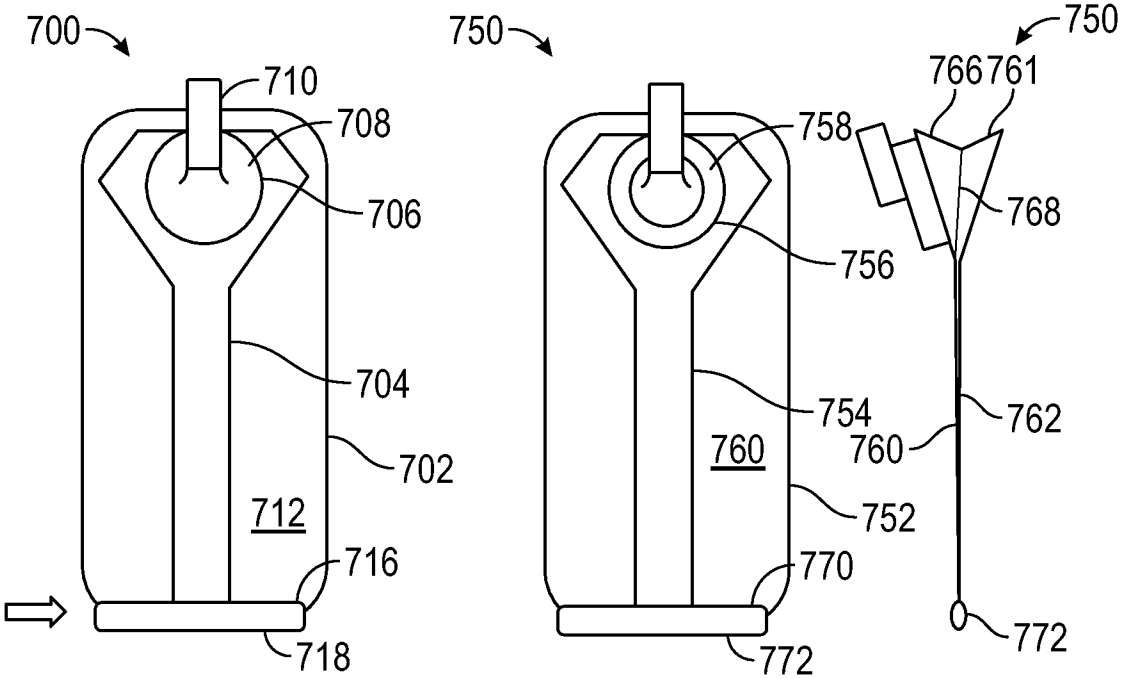
FIG. 33 shows a bladder having a sliding bottom closure.
FIGS. 34-35 show a bladder having a sliding bottom closure and a gusseted top.
FIGS. 36-37 show a bladder having a front fluid port that includes a rotating valve.

FIGS. 33-37 illustrate various bladder options for reservoirs in accordance with the present disclosure. For example, as illustrated in FIG. 33, a reservoir 700 can include a flexible bladder 702, a strut member 704 and a spout assembly 706 including a cap 708. The spout assembly 706 and/or the strut member 704 may be disposed on a first side of the bladder 702. The cap 708 can include an outlet valve 710, such as a bite-valve that can be operated by biting on the valve. The strut member 704 can include a first portion having a substantially irregular hexagon shape and a second portion extending from the first portion having a substantially rectangular shape.

The bladder 702 can include a first sheet 712 and a second sheet. The first and/or second sheet 712 can include a substantially rectangular shape having rounded corners. In some embodiments, the second sheet can be substantially coextensive with the first sheet 712. The bladder 702 can include a bottom opening 716 that can be removably sealed via a clip or a slider mechanism 718 or other removably sealing means. Additionally and/or alternatively, the bladder 702 can include a top opening that can be removably sealed via a clip or a slider or other removably sealing means.

As illustrated in FIGS. 34-35, a reservoir 750 can include a flexible bladder 752, a strut member 754 and a spout assembly 756 including a cap 758. The spout assembly 756 and/or the strut member 754 may be disposed on a first side of the bladder 752. The cap 758 can include an outlet valve, such as a bite-valve that can be operated by biting on the valve. The bladder 752 can include a first sheet 760, a second sheet 762 and a gusset 764. The gusset 764 can include a gusset piece 766 having central fold 768 such that excess material of the gusset piece 766 folds inwards towards the center of the bladder 752. The bladder 752 can include a bottom opening 770 that can be removably sealed via a clip or a slider mechanism 772 or other removably sealing means.

FIGS. 36-37 illustrate a reservoir 800 including a flexible bladder 802, a strut member 804 and a spout assembly 806 including a cap 808. The spout assembly 806 and/or the strut member 804 may be disposed on a first side of the bladder 802. The cap 808 can include an outlet valve 810, such as a bite-valve that can be operated by biting on the valve. The cap 808 and/or outlet valve 810 can include an open position, in which fluid can flow from the bladder through the outlet valve 810 (FIG. 36), and an off position, in which fluid is blocked from flowing out of the outlet valve 810 (FIG. 37).

Figures 38, 39, 40, 41, 42, 43:
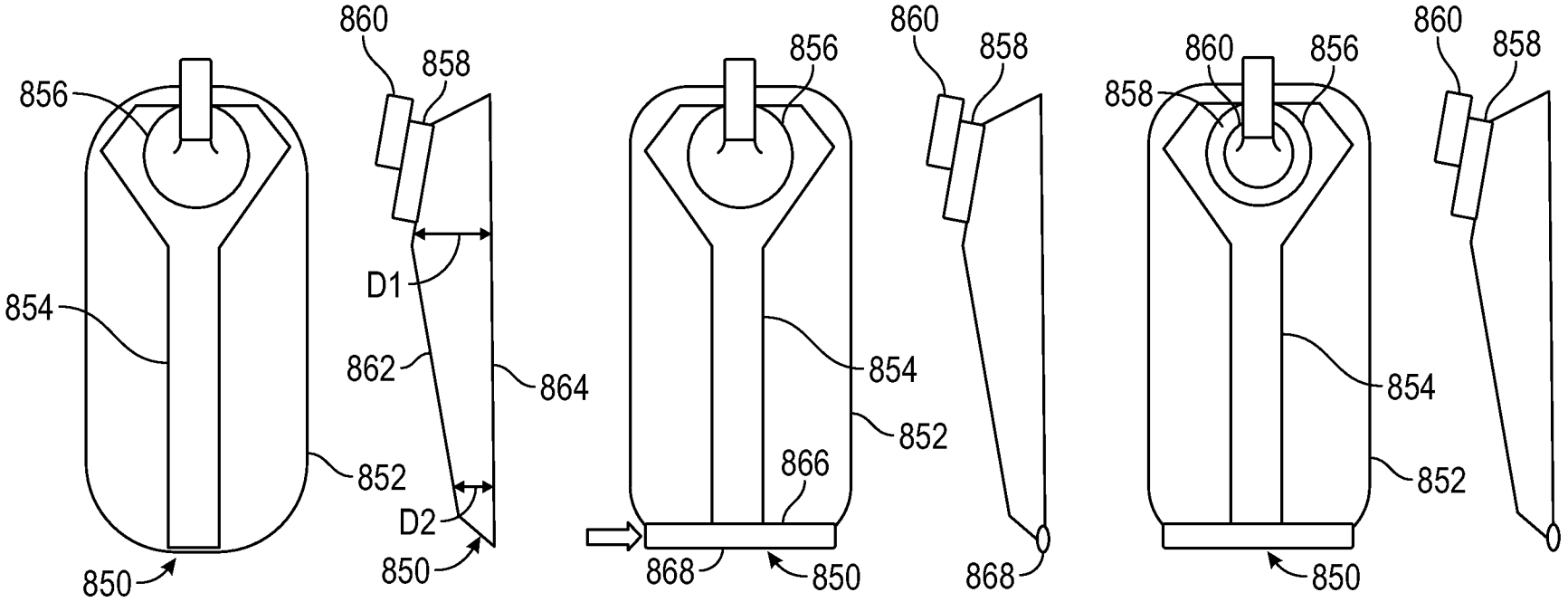
FIGS. 38-39 show a bladder having a shaped front wall and a front strut member and fluid port.
FIGS. 40-41 show a bladder having a shaped front wall, a front strut member and fluid port, and a sliding bottom closure.
FIGS. 42-43 show a bladder having a shaped front wall, a front strut member, a rotating fluid port valve, and a sliding bottom closure.

FIGS. 38-43 illustrate various bladder options for reservoirs in accordance with the present disclosure. For example, as illustrated in FIG. 38, a reservoir 850 can include a flexible bladder 852, a strut member 854 and a spout assembly 856 including a cap 858. The spout assembly 856 and/or the strut member 854 may be disposed on a first side of the bladder 852. The cap 858 can include an outlet valve 860, such as a bite-valve that can be operated by biting on the valve. The strut member 854 can include a first portion having a substantially irregular hexagon shape and a second portion extending from the first portion having a substantially rectangular shape.

The bladder 852 can include a first sheet 862 and a second sheet 864. The second sheet 864 can include a substantially planar configuration. The first sheet 862 can be larger than the second sheet 864. For example, the first sheet 862 can include a three dimensional shape such that the spout assembly 856 and/or strut member 854 are elevated above the second sheet 864. The first sheet 862 can be molded to include the three dimensional shape and/or the first sheet 862 can be attached to the strut member 854, wherein the strut member 854 is molded into a non-planar shape. The bladder 852 can include a first depth D1 at a top portion and a second depth D2 at a bottom portion. The first depth D1 can be greater than the second depth D2.

As illustrated in FIGS. 40-41, in some embodiments the bottom portion can include a bottom opening 866 than can be removably sealed via a clip or a slide mechanism 868. Additionally and/or alternatively, as illustrated in FIGS. 42-43, the cap 858 and/or outlet valve 860 can include an open position, in which fluid can flow from the bladder 852 through the outlet valve 860 (FIG. 42), and an off position, in which fluid is blocked from flowing out of the outlet valve 860 (FIG. 43).

Any flexible and waterproof material can be used for the bladder, such as various polymeric materials. The rigid components (e.g., spout portion, back plate, optionally the connector, strut member) can comprise any sufficiently rigid material, such as polymers, metals, etc. The disclosed reservoirs can have any dimensions and fluid capacities. The relative dimensions provided as examples herein are just examples and are not limiting. Any of the disclosed reservoirs can be part of a system that also includes various other components, such as drink tubes, dispensing valves, back packs to hold the reservoirs, cleaning instruments, etc. The components of the disclosed reservoirs can be secured together in any suitable manner, such by using adhesives, by welding, by using mechanical fasteners, etc.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Integers, characteristics, materials, and other features described in conjunction with a particular aspect, embodiment, or example of the disclosed technology are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods. As used herein, the terms "a", "an", and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A", "B,", "C", "A and B", "A and C", "B and C", or "A, B, and C." As used herein, the term "coupled" generally means physically coupled or linked and does not exclude the presence of intermediate elements between the coupled items absent specific contrary language.

In view of the many possible embodiments to which the principles of the disclosed technology may be applied, it should be recognized that the illustrated embodiments are only examples and should not be taken as limiting the scope of the disclosure.

The invention claimed is:

1. A bladder assembly comprising:

a bladder comprising a front wall and a rear wall and defining an internal reservoir for containing fluid;

a fluid port coupled to the front wall of the bladder and providing fluid access to the internal reservoir; and a strut coupled to the front wall of the bladder, the strut comprising a material that is relatively more rigid than the front wall of the bladder such that the strut defines a shape of the bladder; and a cap that is attachable over the fluid port, wherein the cap comprises an outlet port mounted in the cap, and wherein the outlet port is rotatably adjustable relative to the cap to adjust the outlet port between an open position and a closed position.

2. The assembly of claim 1, wherein the strut is welded to the front wall of the bladder.

3. The assembly of claim 1, wherein the rear wall is flat and the front wall is curved, and the strut is curved to define the curved shape of the front wall.

4. The assembly of claim 1, wherein the strut extends around the fluid port.

5. The assembly of claim 1, wherein the strut has an upper portion, a lower portion, and an intermediate portion that is narrower than the upper and lower portions.

6. The assembly of claim 1, wherein the strut and the fluid port are integrated as one piece of material.

7. The assembly of claim 1, wherein the strut is separate from the fluid port and is removable from the bladder and replaceable onto the bladder, and the strut is attachable to the bladder by securing a cap over the fluid port.

8. The assembly of claim 1, wherein the strut comprises a handle that extends away from the front wall of the bladder.

9. The assembly of claim 1, wherein the strut comprises a finger loop that extends away from the front wall of the bladder.

10. The assembly of claim 1, wherein the strut comprises two lateral wings positioned on opposite sides of the fluid port and spaced apart from the front wall of the bladder.

11. The assembly of claim 1, wherein the strut has a Y shape including a leg portion that extends down from the fluid port, a first arm portion that extends upwardly from and to a first side of the fluid port, and a second arm portion that extends upwardly from and to a second side of the fluid port.

12. The assembly of claim 1, wherein the bladder has a gusseted bottom portion.

13. A bladder assembly comprising:

a bladder comprising a front wall and a rear wall and defining an internal reservoir for containing fluid;

a fluid port coupled to the front wall of the bladder and providing fluid access to the internal reservoir; and a strut coupled to the front wall of the bladder, the strut comprising a material that is relatively more rigid than the front wall of the bladder such that the strut defines a shape of the bladder;

wherein the strut comprises two grip portions positioned on opposite sides of the fluid port, the grip portions being detached from the front wall of the bladder and able to flex away from the front wall of the bladder toward the fluid port, such that the grip portions allow a user to insert fingers under the grip portions to grasp the bladder assembly;

the bladder assembly further comprising a cap that is attachable over the fluid port, an outlet port mounted in the cap, and a mouth-actuated bite valve at a distal end of the outlet port, and wherein the outlet port and the bite valve pivot relative to the cap to adjust the outlet port between an open position and a closed position.

14. The assembly of claim 13, wherein the entire strut is welded to the front wall of the bladder, except for the grip portions.

15. The assembly of claim 13, wherein the bladder is preformed such that the rear wall is flat and the front wall is curved, and the strut is curved to reinforce the preformed curved shape of the front wall of the bladder.

16. The assembly of claim 1, further comprising a mouth-actuated bite valve coupled to a distal end of the outlet port.

17. The assembly of claim 16, wherein the outlet port extends through a center portion of the cap and forms a right angle such that that the distal end and the bite valve project perpendicularly from a flow axis of the fluid port, and wherein the distal portion and the bite valve pivot about the flow axis between the open and closed positions of the outlet port.

18. A bladder assembly comprising:

a bladder comprising a front wall and a rear wall and defining an internal reservoir for containing fluid;

a fluid port coupled to the front wall of the bladder and providing fluid access to the internal reservoir; and a strut coupled to the front wall of the bladder, the strut comprising a material that is relatively more rigid than the front wall of the bladder such that the strut defines a shape of the bladder;

wherein the strut comprises two grip portions positioned on opposite sides of the fluid port, the grip portions being detached from the front wall of the bladder and able to flex away from the front wall of the bladder toward the fluid port, such that the grip portions allow a user to insert fingers under the grip portions to grasp the bladder assembly;

the bladder assembly further comprising an outlet port mounted in a seam between the front and rear walls at the top of the bladder, and an outlet tube that extends through the fluid outlet port into the internal reservoir;

wherein the fluid outlet port comprises a base portion fixed to the bladder, a collar, and an o-ring, wherein the o-ring is held between the base portion and the collar and seals against an outer surface of the outlet tube while allowing the outlet tube to slide longitudinally through the outlet port.

19. The assembly of claim 18, wherein the outlet tube has an extend position wherein a majority of the outlet tube is positioned outside of the internal reservoir, and the outlet tube has a retracted position wherein a majority of the outlet tube is inside the internal reservoir;

wherein the outlet tube is formed of a material that is relatively more rigid than the bladder, such that in the retracted position the outlet tube serves as a rigid strut that provides column strength to the bladder.

20. The assembly of claim 18, wherein the bladder is preformed such that the rear wall is flat and the front wall is curved, and the strut is curved to reinforce the preformed curved shape of the front wall of the bladder.

* * * * *